US011541277B2

(12) United States Patent
Turner

(10) Patent No.: US 11,541,277 B2
(45) Date of Patent: Jan. 3, 2023

(54) PORTABLE THERAPEUTIC STRENGTHENING APPARATUS USING ADJUSTABLE RESISTANCE

(71) Applicant: Jennifer-Jane Turner, Sheffield (GB)

(72) Inventor: Jennifer-Jane Turner, Sheffield (GB)

( * ) Notice: Subject to any disclaimer, the term of this patent is extended or adjusted under 35 U.S.C. 154(b) by 0 days.

(21) Appl. No.: 16/973,633

(22) PCT Filed: Apr. 17, 2019

(86) PCT No.: PCT/GB2019/000060
§ 371 (c)(1),
(2) Date: Dec. 9, 2020

(87) PCT Pub. No.: WO2019/239088
PCT Pub. Date: Dec. 19, 2019

(65) Prior Publication Data

US 2021/0245003 A1 Aug. 12, 2021

(30) Foreign Application Priority Data

Jun. 11, 2018 (GB) ..... 1809564
Oct. 16, 2018 (GB) ..... 1816842

(51) Int. Cl.
*A63B 23/08* (2006.01)
*A63B 21/00* (2006.01)
(Continued)

(52) U.S. Cl.
CPC ..... *A63B 23/085* (2013.01); *A63B 21/00065* (2013.01); *A63B 21/023* (2013.01);
(Continued)

(58) Field of Classification Search
CPC ..... A63B 21/00065; A63B 21/00058; A63B 21/00061; A63B 21/00178; A63B 21/02;
(Continued)

(56) References Cited

U.S. PATENT DOCUMENTS 3,717,144 A 2/1973 Bimler
4,220,991 A 9/1980 Hamano et al.
(Continued)

FOREIGN PATENT DOCUMENTS

DE 3037619 A1 5/1982
WO 2010139015 A1 12/2010

*Primary Examiner* — Megan Anderson
(74) *Attorney, Agent, or Firm* — Dickinson Wright PLLC; Andrew D. Dorisio

(57) ABSTRACT

A lightweight, portable leg strengthening apparatus includes a footplate and calf support which form a leg rest, a top a friction free sliding element running longitudinally along and supported on a rectangular base. The leg rest is hinged at its attachment to the sliding element to allow a longitudinal tilting movement. The leg rest has adjustability at the hinge point at the ankle to enable alterations in the foot position. The apparatus uses resistance material/rubber cords or springs attached via a plate to a steel cable, travelling via an aperture in the end of the device to the back of the sliding element a top the body of the device to create tension as the leg rest a top the sliding element is moved longitudinally along the body of the device. Resistance can be varied and progressed by using different numbers of resistance cords/springs.

14 Claims, 34 Drawing Sheets

(51) Int. Cl.

| | |
|---|---|
| ***A63B 21/02*** | (2006.01) |
| ***A63B 21/04*** | (2006.01) |
| ***A63B 21/055*** | (2006.01) |
| ***A63B 23/035*** | (2006.01) |
| ***A63B 21/16*** | (2006.01) |

(52) U.S. Cl.
CPC ..... *A63B 21/0428* (2013.01); *A63B 21/0552* (2013.01); *A63B 21/154* (2013.01); *A63B 21/1609* (2015.10); *A63B 21/1672* (2015.10); *A63B 21/4011* (2015.10); *A63B 21/4015* (2015.10); *A63B 21/4034* (2015.10); *A63B 21/4039* (2015.10); *A63B 21/4047* (2015.10); *A63B 23/03508* (2013.01); *A63B 2208/0252* (2013.01); *A63B 2210/50* (2013.01); *A63B 2225/09* (2013.01)

(58) Field of Classification Search
CPC ..... A63B 21/025; A63B 21/023; A63B 21/04; A63B 21/0407; A63B 21/0428; A63B 21/0442; A63B 21/055; A63B 21/0552; A63B 21/0555; A63B 21/0557; A63B 21/154; A63B 21/1672; A63B 21/1609; A63B 21/4011; A63B 21/4013; A63B 21/4015; A63B 21/4033; A63B 21/4031; A63B 21/4034; A63B 21/4039; A63B 21/4045; A63B 21/4047; A63B 2208/0233; A63B 2208/0238; A63B 2208/0252; A63B 23/085; A63B 2210/02; A63B 2210/05; A63B 23/03508; A63B 23/0417; A63B 23/04; A63B 2210/50; A63B 2225/09; A61H 1/0259
See application file for complete search history.

(56) References Cited

U.S. PATENT DOCUMENTS

| | | | | |
|---|---|---|---|---|
| 4,637,379 | A | 1/1987 | Saringer | |
| 6,149,554 | A * | 11/2000 | Ferguson | A63B 21/4045 482/90 |
| 6,416,448 | B1 | 7/2002 | Hassler | |
| 7,137,936 | B1 | 11/2006 | Shaw et al. | |
| 9,108,080 | B2 | 8/2015 | Cataldi et al. | |
| 9,510,989 | B2 * | 12/2016 | Method | A61H 1/00 |
| 2003/0195095 | A1 * | 10/2003 | Endelman | A63B 21/023 482/142 |
| 2006/0211957 | A1 | 9/2006 | Beny et al. | |
| 2009/0083901 | A1 * | 4/2009 | Pardillo | A41D 13/065 2/455 |
| 2010/0016131 | A1 | 1/2010 | Hoffman | |
| 2010/0216612 | A1 * | 8/2010 | Graham | A63B 23/0417 482/121 |
| 2011/0112455 | A1 | 5/2011 | Rocklin | |
| 2012/0232438 | A1 * | 9/2012 | Cataldi | A63B 21/4045 601/5 |
| 2013/0232814 | A1 * | 9/2013 | Blum | A43B 7/1464 36/43 |
| 2013/0245510 | A1 | 9/2013 | Zaborowski | |
| 2014/0009472 | A1 | 1/2014 | Ajitomi et al. | |
| 2014/0045664 | A1 * | 2/2014 | Hockridge | A63B 69/0057 482/142 |
| 2014/0088466 | A1 | 3/2014 | Hansen | |
| 2014/0094721 | A1 | 4/2014 | Diallo | |
| 2015/0119204 | A1 | 4/2015 | Loane et al. | |
| 2015/0273265 | A1 * | 10/2015 | Spinosa | A63B 21/15 482/140 |
| 2016/0279008 | A1 * | 9/2016 | Limoni | A61G 13/1245 |
| 2019/0290953 | A1 * | 9/2019 | Anderson | A63B 21/075 |

* cited by examiner

PORTABLE THERAPEUTIC STRENGTHENING APPARATUS USING ADJUSTABLE RESISTANCE

FIELD OF THE INVENTION

The present invention relates to a portable device for strengthening leg muscles.

BACKGROUND OF THE INVENTION

When a person is unwell or injured and is immobile for a period, they can lose up to 20% of muscle strength within the first 7 days. It is common for patients in hospital to be in bed for extended periods of time, especially those who are more elderly and frail, have suffered fractures or have complex multi pathologies. The significant and rapid reduction of muscle strength otherwise known as the de-conditioning effect, can be extreme for bed ridden patients and can have life changing effects. Physiotherapists have limited time and are under a huge amount of pressure to successfully rehabilitate these patients and get them home quickly. There is limited effective strengthening equipment available to use with patients and there is a need for a better solution to speed up the rehabilitation process.

In order to treat de-conditioned muscles, leg muscles in particularly, physiotherapists require a muscle strengthening machine that is safe and effective and can be used in the correct manner by the patient independently. They need to be able to set a patient up on a device and be confident that the patient can utilize the equipment easily so that they can manage their own exercises safely and well. This will allow the Physiotherapist the ability to treat another patient nearby, therefore optimizing their time allowing more patients to be treated.

Known strengthening equipment currently available for use by Physiotherapists include resistance bands, which are elastic bands typically held in place during exercise to increase the resistance experienced by the exerciser to increase strength of the exercised muscle. However, whilst resistance bands are portable and inexpensive, many patients find them too difficult to hold in the correct position for doing leg strengthening exercises. Furthermore, injuries have been reported, whereby the band may snap, causing injury to the skin or eyes, the band may dig into fragile skin on the outside edge of the foot causing pressure damage or the user may also become tired and release a grip on one side of the band thus incurring injury. It is also easy for an inexperienced user to use the resistance band incorrectly, applying resistance to an incorrectly executed exercise rendering the exercise ineffective and potentially damaging.

Alternative forms of rehabilitation are available for example the use of ankle weights in combination with physical activity or use of a static bicycle or pedals. However, such weights applied for example around a user's ankle can damage fragile patient's skin. Static bicycles are expensive, heavy and awkward to move longer distances and these gym-style apparatuses require a user to perform the exercise with both lower limbs together. There are many patients for example, those with lower limb fractures in plaster, splints or external fixators, spinal injuries, stroke, those lacking core stability and control, that these are not suitable for and are better served by equipment that enables the use of one leg at a time. It is a further problem that some patients need to be restricted to bed rest due to their condition, this causes complications to be able to exercise the leg muscles sufficiently as they cannot weight bear or do standing exercises.

Known static gym-style devices cannot be used on a bed or whilst the user is sitting in a chair.

Strengthening equipment in the form of exercise devices which employ movement along a horizontal plane against resistance are known. However, these are not lightweight, and due to having irregular metal edges can incur tissue damage from sharp edges, increasing the risk of infection by users. Such devices are not safe enough for unsupervised use for many patient groups.

It is a problem with known strengthening exercises which employ movement along a horizontal plane against resistance that the machines only have a foot plate and do not support the leg adequately to allow for unsupervised use by weaker patients. To achieve the desired strengthening results, the lower leg needs to be maintained in a safe, stable position. It is advantageous to have the calf and ankle supported to maintain a correct position throughout the exercise period to avoid any misalignment of the lower leg occurring due to fatigue or user error. Therefore, there is a need for a piece of equipment which can be used unsupervised, which maintains and supports the position of the lower leg in relation to the angle of the foot, that will address the problem of unsupervised strengthening patients' leg muscles whilst fully supporting the patients leg in a safe and comfortable way. Further, because people have varying degrees of flexibility of their ankles such apparatus need to be able to accommodate variability in the angle of ankle movement to ensure that all users can perform the exercise comfortably.

Known exercising equipment has a flat foot plate that the user places their feet on whilst performing the exercise. This is problematic since the force exerted by a user transfers pressure through the heel area which is at risk of breaking down in those that are frail and on sustained bed rest. There is a need for a device which ensures that no pressure goes through the heel area of the user, to avoid the potential for skin destruction and long-term complications of such an event. For those users who already have broken skin on their heels or pressure sores, they need to be able to use leg strengthening equipment safely without any further risk or damage to their skin condition.

It is a further problem with prior art exercise devices which employ movement along a horizontal plane against resistance that they do not include stops or means to limit the user's joint movement when using the device. Thus, a user can engage in physical movement of their leg beyond what is appropriate for their condition thus potentially causing muscle or joint damage.

Known devices are typically configured to exercise either the quadriceps or the hamstrings and lack the versatility to be used interchangeably for both.

Accordingly, there is a need for an inexpensive, lightweight and portable, exercising device which can be used interchangeably to exercises either the hamstring or quadriceps and which can be used unsupervised for treatment of lower limb de-conditioning. The apparatus should be versatile so that users in bed or in a chair can perform the exercises equally as effectively and there is a necessity for the device to be simple to set up and use independently. The apparatus needs to be safe for those with pressure sores to use and prevent damaging heel tissue whilst performing their required exercises. It needs to be easy to use and easy to store so that hospitals and independent users at home can get benefit from use of the device.

SUMMARY OF THE INVENTION

Accordingly, it is the primary goal of the present invention to provide a portable, safe and effective device for leg muscle strengthening. According to a first aspect there of the present invention, there is provided a portable therapeutic leg strengthening apparatus comprising:

a longitudinal body having first and second ends;

a guide member moveable between said first and second ends in a direction substantially parallel to a main length of said longitudinal body;

a footplate pivotally connected to said guide member;

a calf support adjustably connected to said footplate;

one or a plurality of resiliently biased means; and a connecting means for connecting said one or a plurality of resiliently biased means to said guide member;

said one or a plurality of resiliently biased means providing variable resistance to said connecting means to increase or decrease the force required by said user to move said guide member between said first and second ends of said longitudinal body;

wherein an angle of connection between the footplate and the calf support is adjustable; and wherein said footplate and said calf support form a leg rest, configurable between first and second configurations, such that:

in said first configuration the leg rest is arranged such that the guide member is pushed against the resistance generated by said one or more resiliently biased means between said first and second ends of the device to exercise the quadriceps and in said second configuration the guide member is pulled against the resistance generated by said one or more resiliently biased means between said first and second ends of the device to exercise the hamstring.

Advantageously the guide member is rotatable by substantially 180° relative to the longitudinal body of the device about a pivot point.

Preferably, the angle of the footplate and the calf support are adjustably joined by a hinge.

It is envisaged that the footplate is a two-part assembly for ease of manufacture and/or storage and transportation.

Preferably, the apparatus further comprises a removable heel support locatable within said footplate, configurable between first and second positions, such that:

in a first position the footplate is arranged such that a user exerts pressure though the ball of the foot to move the guide member between first and second ends of the longitudinal body and in a second position the footplate is arranged so that the user exerts pressure through their heel to move the guide member between first and second ends of the longitudinal body.

Advantageously, the removable heel support allows the area through which a user of the apparatus exerts force to be adjusted. In the presence of the heel support pressure can be exerted through the heel. The ability to apply full pressure through the heel to the device is important for individuals with for example neurological conditions who need to exercise their limbs without increasing tone in the leg muscles. When the device is used without the heel support pressure is exerted through the ball of the foot rather than the heel. The absence or significant reduction of pressure through the heel area is particularly advantageous to patients who have pressure sores or fragile skin on their heels but still require action of movement of the device. The adjustability of the device allowing pressure to be exerted either through the ball of the foot or the heel allows the device to be adapted to an individual patient's needs.

It is envisaged that the device will include a removable liner which assists in the comfort of the user. Furthermore, because of the removable nature of the liner, the device can be used by multiple individuals changing the internal liner for hygiene purposes between users.

Preferably the removable liners will be magnetically aligned with the footplate and calf support for easy fitting.

It is envisaged that the footplate and calf support will be replaceable with a gripping portion to allow the device to be used to exercise the upper body and/or arms or a smaller 'leg rest' for use by children.

Advantageously the device will include a manual or electronic counter since there is a need when exercising to accurately record the number of repetitions that the user has performed so the therapist and user can keep track of easily, see progress and assess improvement.

Preferably the connecting means will be a steel cable which is hard wearing and durable.

The present invention has a foot support and calf support otherwise referred to as a 'leg rest'. The foot support and calf support are attached to a sliding element or guide member that moves longitudinally along the body of the device. The calf support has a shaped length of plastic material; covered by pressure relieving material; which supports the patient's calf in a comfortable relaxed position. The foot support is attached to the calf support piece by a hinged joint to allow for changes of angle of user's foot position. The foot and calf support has no material that comes into contact with the user's heel. All pressure from the user is through the forefoot to push the siding element along the body of the device. The sliding element or guide member may be a nylon slide plate, an aluminium slide plate or a trolley Having a 'leg rest' ensures that the therapist and patient are confident that the entire set of exercises will be done correctly as it will not allow the user's leg to drift out of alignment as the muscles fatigue. The 'leg rest' also enables the user's leg to be supported against gravity allowing the user to perform more exercises before the leg muscles fatigue.

The 'leg rest' of the present invention will be designed to not allow the user to put any pressure through the heel area of their foot. This will ensure safe use by those users with heel sores and prevent other users damaging the delicate skin on their heels. The material used in the lining of the 'leg rest' will have pressure relieving qualities and comply with tissue viability and infection control global policy.

The 'leg rest' of the present invention will also have an adjustable ankle position, to allow for individual setting for each user to ensure comfort of foot position throughout the movement/exercise period. This is due to all people having different degrees of available movement of their ankles.

The entire 'leg rest' of the present invention can tilt in the longitudinal plane. This enables maintenance of support of the user's lower leg as the user extends the knee out along the length of the device and flexion of the leg as the user returns the sliding element back to the start position at the rear of the device. The present invention will also therefore help to improve range of movement of the hip and knee due to the movement of the sliding element and 'leg rest' along the length of the device.

The present invention has a sliding element on which sits the pivoting 'leg rest'. The friction free property of the sliding element is such that the user can move the trolley with using minimal exertion for those who have extremely weak muscles and just starting their rehabilitation. The friction free sliding element will ensure a quiet, smooth movement without jarring effect on the limb whist in use.

To achieve the versatility desired for the apparatus to be used by a wide variety of patients including those on the bed or for users sitting in a chair, the present invention has support legs that can be rotated out from under the device and locked into position for use in a chair or the legs can be folded/rotated away under the device and clipped into place to allow for use on a bed.

The present invention is lightweight and portable enough to carry easily. It has a handle on its side elevation for carrying. The leg rest folds down flat against the device and the legs will rotate away under the device and secure for optimal ease of transportation and portability.

The present invention is manufactured out of material that complies with infection control and tissue viability policy and will not be damaged by the necessary cleaning processes. Clinicians and users will be able to wipe the machine down easily due to the shape and design of the body of the device this having smooth lines and surfaces and no cracks or indentations for dirt or dust to gather.

To comply with infection control policy the device is designed so that the internal mechanical workings are at least partially, preferably fully covered. This is to minimize the accumulation of dust and skin cells around the workings and also assists in maintaining the cleanliness of the device and reduces the likelihood of cross infection between users. The sliding element with the 'leg rest' a top will stand minimally proud of the cover on the longitudinal body to allow for smooth movement and effective use of the device.

The device may be used in either a seated position in a chair on by a user on a bed. The position of the legs relative to the body determines the way the device is used. When the legs are substantially perpendicular to the body of the device the device is elevated from the floor and suitable for use by an individual seated in a chair. When the legs of the device at folded flat, the device may be used by an individual on a bed. An additional adjustable stop prevents the device from moving forwardly and sliding along the bed when in use.

To operate the device from a seated position the current invention will have a securing mechanism that attaches to the legs of the user's chair or around the body of a larger recliner chair. This will ensure stability of the device when in use and prevent forward movement away from the chair.

To operate the current invention whilst the user is on the bed, the legs will be folded under the body of the device and secured in place and there will be an adjustable mechanism by means of an adjustable bar, which will extend from the front of the device to butt up against the bed end. This will prevent movement of the device down the bed whilst in use.

Behind the sliding element securing the leg rest, is a flexion block which itself also comprises a sliding element and fixing clip. This block will be required if there needs to be any restriction of knee or hip flexion movement for the user. This is to ensure that there is no possibility of over flexing the joints if there is a medical reason to prevent this i.e. post knee replacement stitches or early post-surgical repair of anterior cruciate ligament. The flexion block can be moved longitudinally along the device to be positioned where is appropriate for individual users.

The present invention incorporates a contact sensor within the apparatus which relays information to a digital display at the rear of the apparatus. This shows the number of full repetitions of movement that have been achieved by the user.

The present invention uses resistance material by means of elastic or rubber cords or springs to create the resistive forces required to enable strengthening of the muscles. There are a plurality of cords or springs available to be used in the present invention. These springs have varying resistance quality. The user is able to have no springs resisting the longitudinal movement for free solely active movement or add in single springs at a time as the muscle strength improves to facilitate effective muscle strengthening through progressive resistance exercise. A steel cable is secured to the back of the sliding element and goes into the device via an aperture at the rear end of the device. Within the body of the device the steel cable is affixed to a metal plate upon which are affixed the resistance providing springs. A plurality of mechanical plungers situated on the top surface of stated device that individually raise or lower into or out of said device to engage or disengage the required and appropriate resistance springs via the loop attachment on the springs. The plunger is raised and lowered manually, but there is no contact between the springs (resistance means) and the user. The resistance of the device can be adjusted by depressing the organ stop type buttons atop the device at the front end to engage the required number of springs and achieve the required level or resistance. The stop mechanically engages and disengage the connections between the resistance means and the connecting means attached to the trolley. This allows a range of adjustment of the resistance rate without any other intervention from the user, e.g.: swapping springs/bands or having to pull and secure extra tension media manually It is envisaged that the extension of the resiliently biased means is regulated by a block and tackle mechanism. Preferably, the block and tackle mechanism comprises three pulleys.

The one or a plurality of resiliently biased means are elastic or rubber cords or the one or a plurality of resiliently biased means are springs.

The apparatus further comprises a means to engage said one or a plurality of springs and said connecting means. Preferably, the means for engaging one or a plurality of springs with the connecting means is a stop.

The footplate and calf support each further comprise a removable liner. Said removable liners are magnetically aligned with the footplate and calf support to prevent loss.

The connecting means is a steel cable.

The apparatus comprises a bed end stop to stabilize the device in use on a bed. Preferably, the bed end stop comprises two elongate support rods. The bed end stop further comprises a bridging piece between said two elongate support rods.

The footplate and calf support are joined by a hinge.

The footplate may comprise a two-part assembly.

The apparatus may include a manual or electronic counter.

Other aspects are as set out in the claims herein, the features of which are incorporated into this summary of invention by reference.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which:

FIGS. 33*a* and 33*b* show the device in quadriceps configuration.

FIGS. 34*a* and 34*b* show the device in quadriceps configuration.

FIGS. 35*a* and 35*b* shows the device in quadriceps configuration.

FIGS. 37*a* and 37*b* show the device in quadriceps configuration.

FIGS. 38*a* and 38*b* show the device in quadriceps configuration.

FIGS. 39*a* and 39*b* show the device in quadriceps configuration.

FIGS. 40*a*, 40*b*, 40*c*. 40*d*, 40*e* and 40*f* show various views of a device in accordance with the fourth embodiment of the invention for use on a bed with legs beneath the device and the bed end stop extended. The device is configured for exercising the quadriceps. FIG. 40*b* is a plan view, FIG. 40*c* is a side view, FIG. 40*d* a rear view and FIG. 40*e* a perspective view.

DETAILED DESCRIPTION OF THE EMBODIMENTS

There will now be described by way of example a specific mode contemplated by the inventors. In the following description numerous specific details are set forth in order to provide a thorough understanding. It will be apparent however, to one skilled in the art, that the present invention may be practiced without limitation to these specific details. In other instances, well known methods and structures have not been described in detail so as not to unnecessarily obscure the description.

Figure 2:
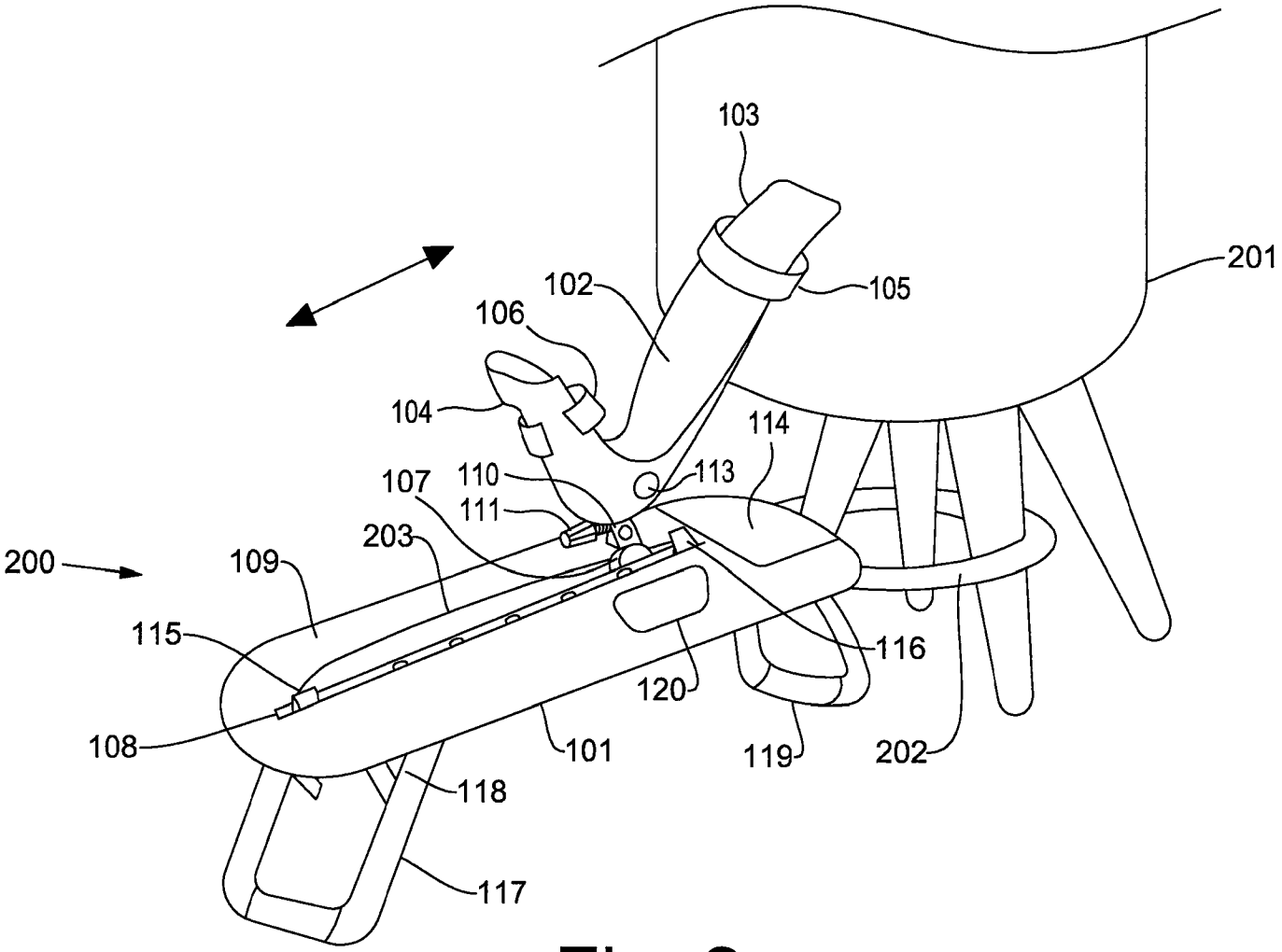
FIG. 2 is a perspective view of a first embodiment of the present invention in chair configuration.
Figure 5:
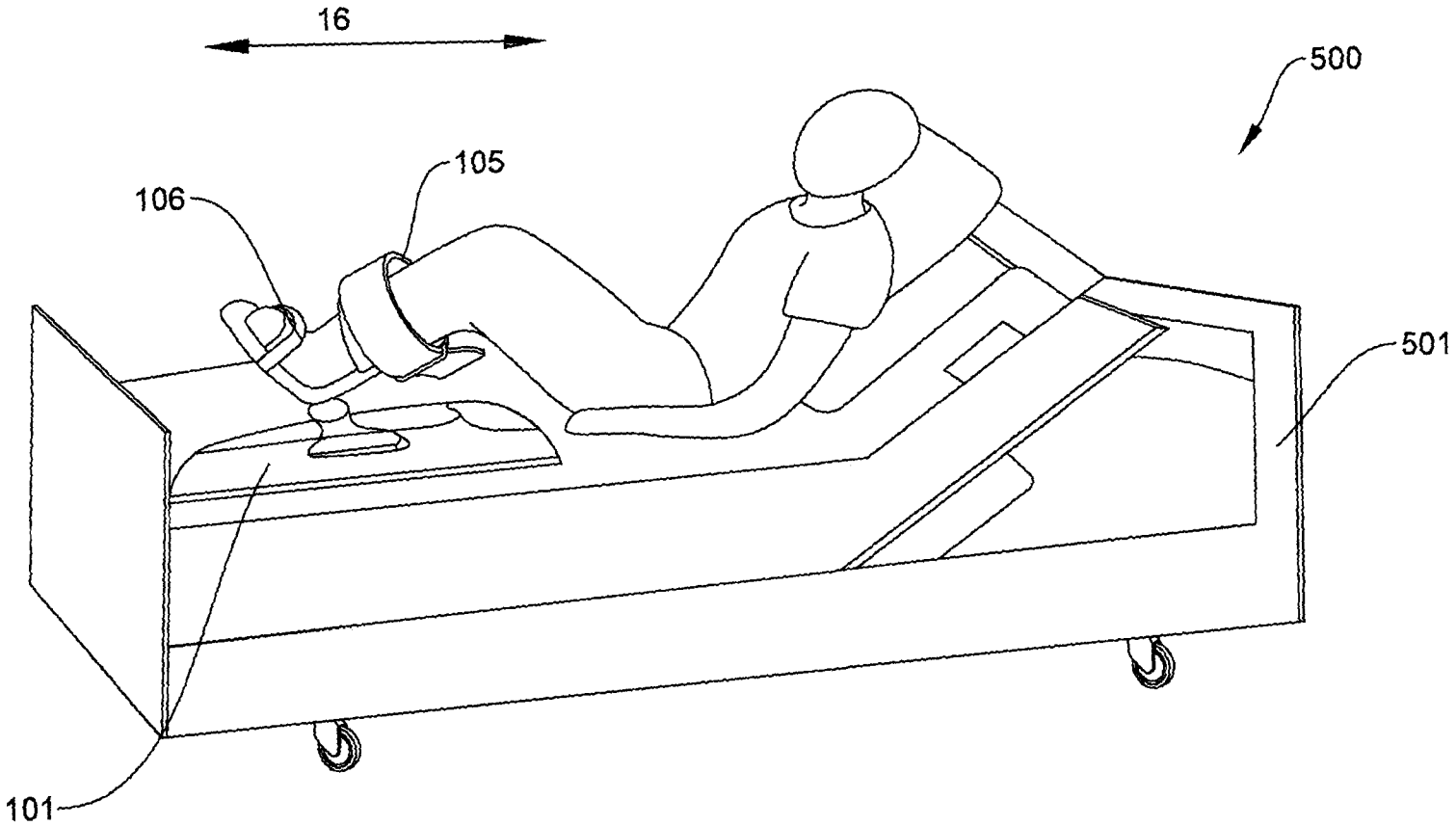
FIG. 5 is a side view of a first embodiment of the present invention in use in a bed configuration.

The present invention is to be used for strengthening the leg muscles, specifically the quadriceps and can be used whilst sitting in a chair as shown in FIG. 2 or when the user is in long sitting on a bed as shown in FIG. 5. The current invention can also be used by a patient who is unable to sit up at all and is in a supine position on the bed, for example those with spinal cord injuries.

Figure 1:
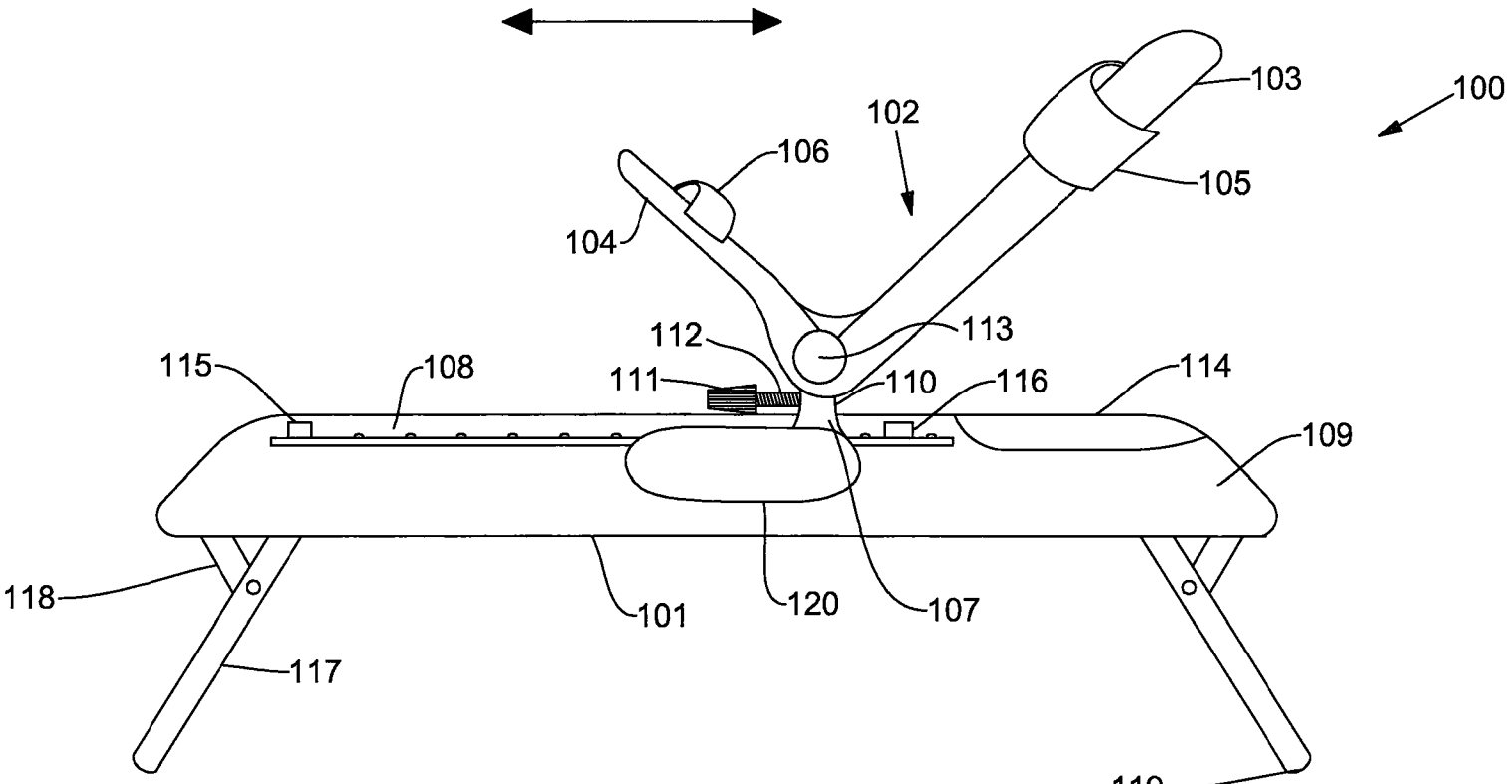
FIG. 1 is a side view of a first embodiment of the present invention.

Referring to FIG. 1 herein there is shown a side view of the device 100 according to a first embodiment of the present invention for use by a seated user to work the quadriceps muscles. The device comprises an elongate body 101 having a leg rest 102 comprising a calf support 103 and foot support 104. Straps 105 and 106 are applied around the calf and the foot respectively to fasten a user's leg to the device. The leg rest 102 is attached to a trolley 107 mounted on a friction-free longitudinal rail 108 which runs the predominant length of the elongate body 101, such that the trolley can move forward and backward along said longitudinal rail 108 in the direction of the arrow. Moving the trolley 107 longitudinally forward is against the resistance of the resistance cords described in FIG. 4.

The friction-free rail is affixed inside the device under a wipeable external cover 109. Attachment of the leg rest 102 to the friction-fee rail 108 mounted within the elongate body 101 is via pivot joint 110. The leg rest 102 has an angle adjusting mechanism 111 to alter the angle between the foot rest 104 and the calf support 103. The angle adjuster 111 is connected to a mechanism 112 that on rotation widens or narrows the heel area 113 between the foot rest 104 and the calf support 103. This ensures individual user specifications depending on the ankle range of movement of each user. In the embodiment shown the heel area 113 does not allow contact with the heel tissue of the user, this is to prevent pressure sores. The user pushes with their forefoot onto the foot rest 104 to propel the trolley 107 that the leg rest 102 is attached to forward along the rail 108 against the resistance of the resistance cords illustrated in FIG. 4. The resistance cords can be accessed through an access hatch 114 (shown with cover on) located on the rear upper surface of the elongate body 101.

Figure 4:
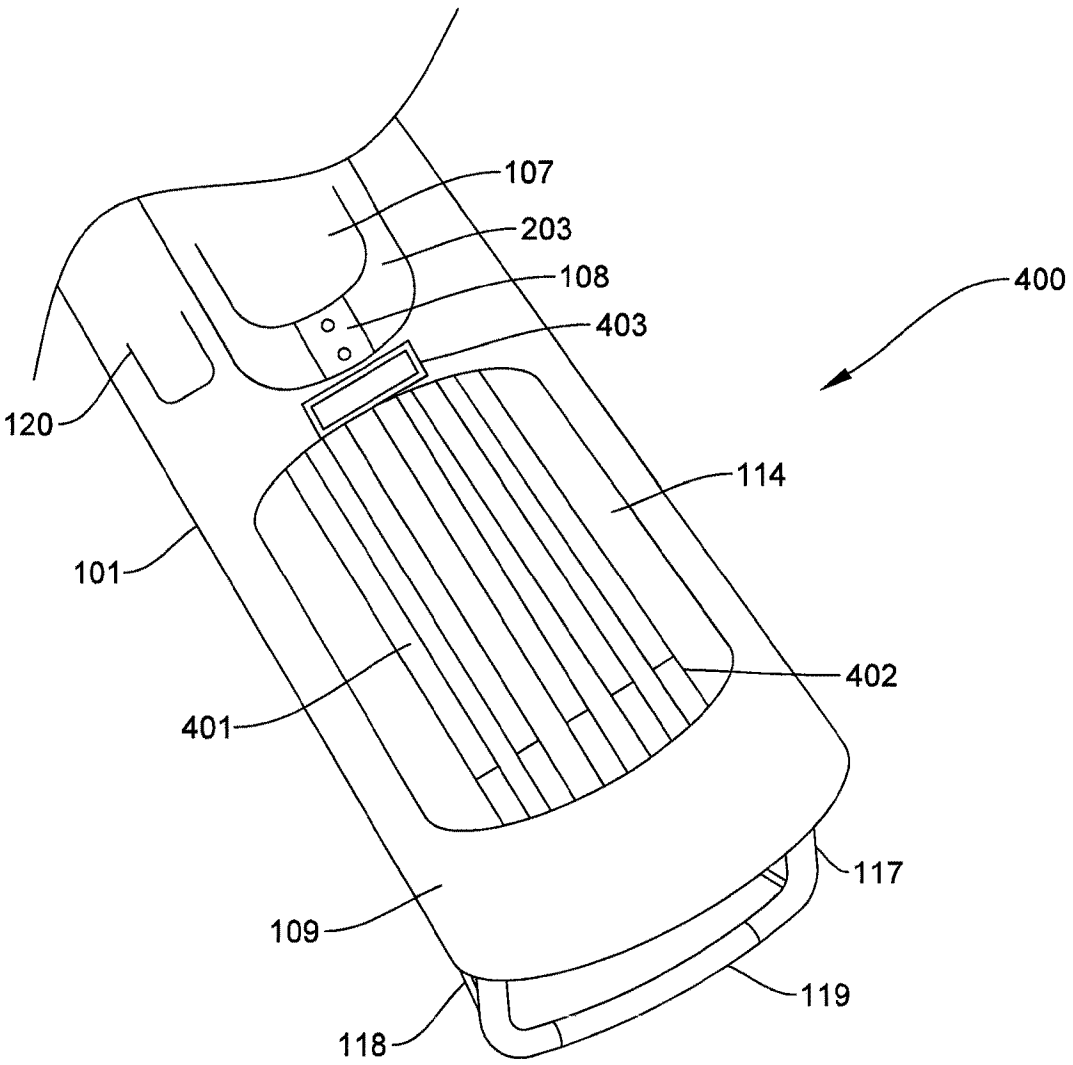
FIG. 4 is a partial perspective rear view of a first embodiment of the present invention in chair configuration.

In use, the trolley 107 is moved forwardly and backwardly by the extension and retraction respectively of a user's leg located in the leg rest 102. A contact sensor 115 located at the front of the friction-free rail 108 relays digital information regarding number of repetitions of full leg extension movements achieved by the user to the screen (403; FIG. 4) at the rear of the device.

The extent of movement of the user's knee and hip can be limited if necessary by use of flexion block 116. The block being attached to the rail 108 behind the mobile trolley 107 and the leg rest 102 and being able to move longitudinally and be secured in place where appropriate for the individual user.

The apparatus is configured to be used by someone sitting in a chair, as illustrated by the supporting legs 117 being rotated outwardly from under the body 101 by way of pivoting struts 118. A non-slip material 119 is applied to the floor contacting area of the support legs 117 to avoid movement of the device when in use in the chair configuration. The device further comprises a carry handle 120 located on the base of the elongate body 101.

Referring to FIG. 2 herein there is shown perspective view 200 of a first embodiment of the present invention, a device for working the quadriceps, shown attached to a chair 201 via the securing mechanism or brace 202. The bracing mechanism 202 attaches the device 101 securely to the chair 201. The elongate body 101 of the device having a leg rest 102 comprising a calf support 103 and foot support 104 is illustrated with like parts denoted by like reference numerals. Straps 105 and 106 are applied around the calf and the foot respectively to fasten a user's leg to the device. The leg rest 102 is attached to a trolley 107 mounted on a friction-free longitudinal rail 108 which runs the predominant length of the elongate body 101, such that the trolley can move forward and backward along said longitudinal rail 108 in the direction of the arrow.

Attachment of the leg rest 102 to the friction-fee rail 108 mounted within the elongate body 101 is via pivot joint 110. The leg rest 102 has an angle adjusting mechanism 111 to alter the angle between the foot rest 104 and the calf support 103. The angle adjuster 111 is connected to a mechanism (see FIGS. 1: 112) which upon rotation widens or narrows the heel area 113 between the foot rest 104 and the calf support 103. This ensures individual user specifications depending on the ankle range of movement of each user. In the embodiment shown the heel area 113 does not allow contact with the heel tissue of the user, this is to prevent pressure sores. The user pushes with their forefoot onto the foot rest 104 to propel the trolley 107 that the leg rest 102 is attached to forward along the rail 108 against the resistance of the resistance cords illustrated in FIG. 4. The resistance cords can be accessed through an access hatch 114 (shown with cover on) located on the rear upper surface of the elongate body 101.

The friction-free rail is affixed inside the device under a wipeable external cover 109. A groove 203 in the top surface of the outer wipeable cover 109 allows contact between the hinged pivot joint 110 of the leg rest 102 and the friction-free rail 108, such that the trolley 107 can be moveably mounted to the rail 108. The groove 203 has an enclosing flap e.g. a rubber or brush strip, to prevent skin cells and debris from falling into the device and onto the rail 108.

In use, the trolley 107 is moved forwardly and backwardly by the extension and retraction respectively of a user's leg located in the leg rest 102.

Figure 3:
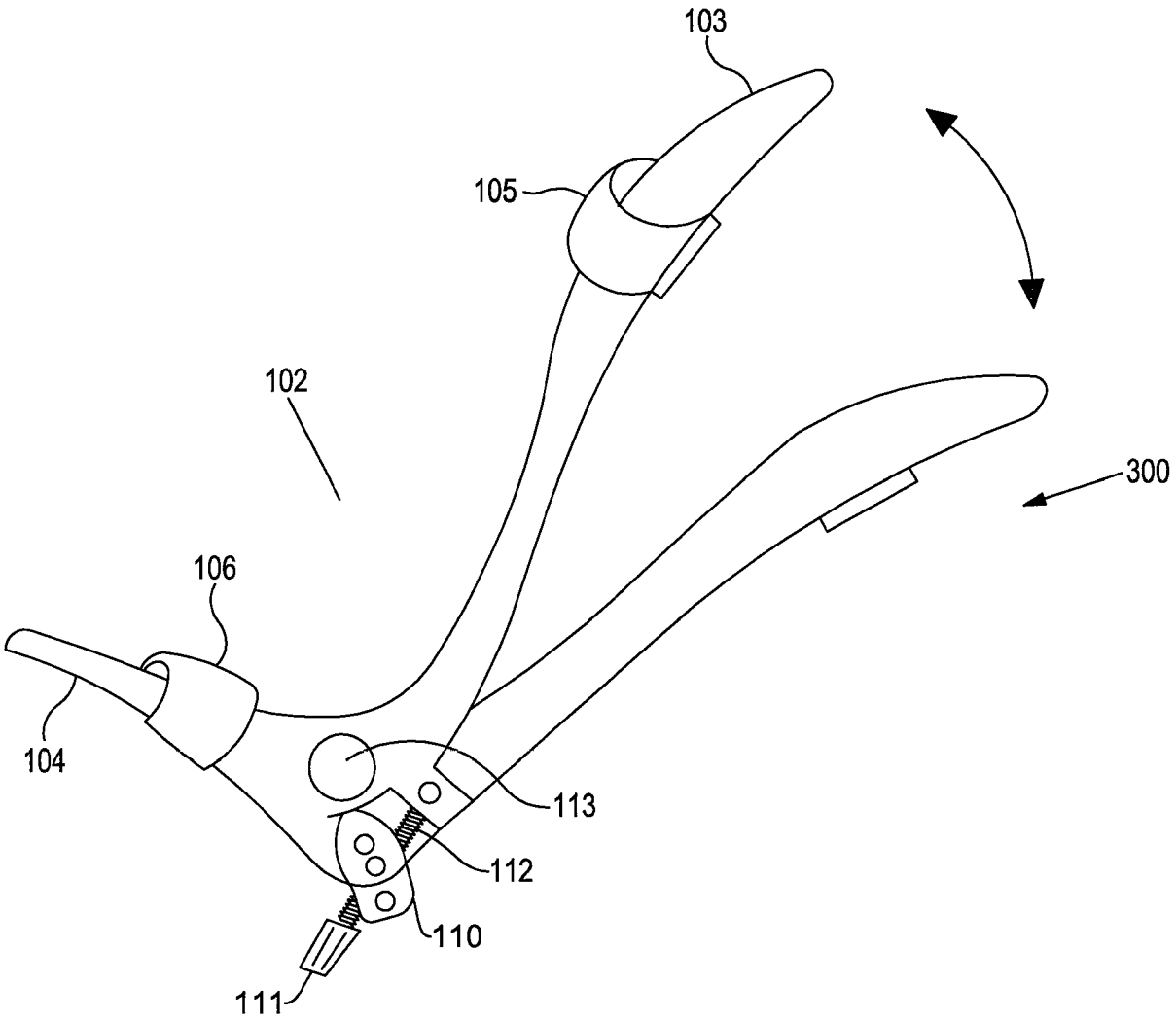
FIG. 3 is a side view of the foot and calf support of a first embodiment of the present invention.

Referring to FIG. 3 herein there is shown a side view 300 of the leg rest 102 comprising a foot 104 and calf support 103 in accordance with a first embodiment of the present invention. The arrow illustrates the direction that the leg rest can pivot and tilt when in use, due to the hinge joint 110. The ankle range of movement adjustment mechanism 111 and threaded insert 112 are also shown.

Referring to FIG. 4 herein there is shown a partial perspective rear view 400 of a first embodiment of the present invention in chair configuration. Like parts are shown by like reference numerals. The device is shown with access hatch 114 located on the rear upper surface of the elongate body 101 uncovered to expose 5 resistance cords 401 arranged in parallel with the elongate body 101 of the device. The resistance cords 401 are anchored at a first end to the trolley 107 and at a second end to anchor points 402 on the rear interior of the body of the device 101. The resistance cords 401 can be easily added in, i.e. attached or unhooked from the rear anchor points 402 depending upon the resistance required by the user.

The contact sensor (115 FIG. 1) at the front of the rail 108 relays digital information regarding number of repetitions of full leg extension movements achieved by the user to the screen 403 at the rear of the device.

Referring to FIG. 5 herein there is shown a side view 500 of a first embodiment of the present invention in use on a bed 501 by a patient in long sitting on the bed.

Figure 6:
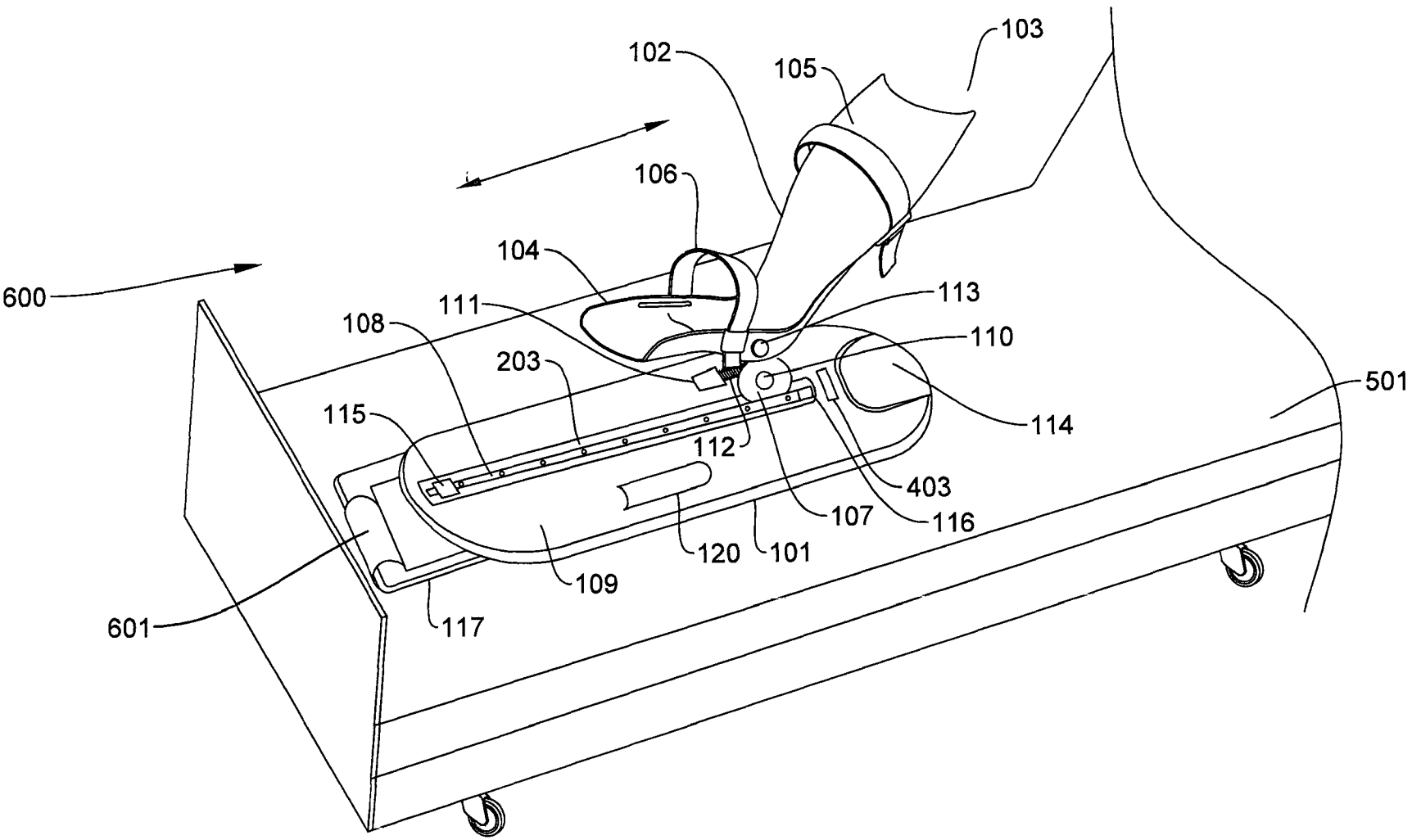
FIG. 6 is a perspective view of a first embodiment of the present invention in use in a bed configuration.

Referring to FIG. 6 herein there is shown is a perspective view 600 of a first embodiment of the present invention in use in a bed configuration. In the bed configuration, the supporting leg 117 at the first end are rotated out for use as the bed end stop whilst the leg at the second end is rotated under the device to provide an adjustable brace 601 which can be set against the bed end to prevent forward movement of the device during use. The bed end stop prevents the device from moving during use. The user is then able to perform the exercise by pushing with their forefoot so that the trolley 107 is moved longitudinally along the rail 108 away from the user, against the resistance of the resistance cords (401; FIG. 4). The user will have been set a number of repetitions of the movement to do and the repetitions can be tracked by user and therapist by looking at the digital rep counter 403.

Figure 7:
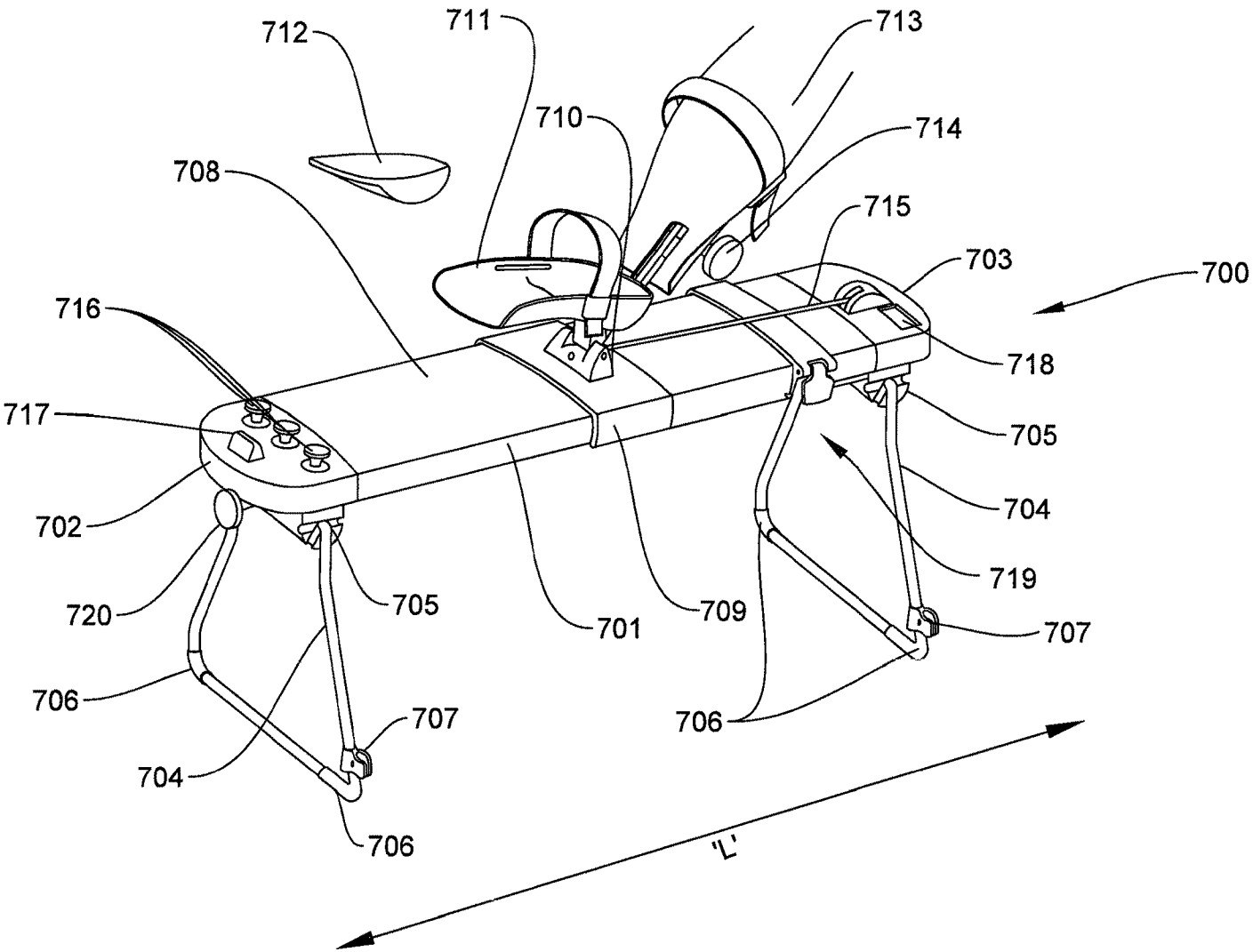
FIG. 7 is a perspective view of a second embodiment of the present invention.

Referring to FIG. 7 herein there is shown a perspective view of a second embodiment of the apparatus of the present invention. The apparatus 700 comprises an elongate body 701 having first 702 and second 703 ends. The apparatus is mounted on a pair of legs 704 in adjustable attachment to the body of the device 701 about pivot points 705. The legs have rubber stoppers 706 or rubber feet to increase friction between the apparatus and the device on which it is placed to prevent the apparatus from slipping. The legs may further comprise joining clips 707 which permit two individual apparatus 700 to be joined together or may assist in joining the device to an anchor point for stability e.g. a chair. The legs are foldable beneath the device so that it can be used folded flat for storage.

The upper surface of the elongate body 701 is a molded plastic shell of polyurethane or an aluminium extrusion 708 over which a nylon slide plate or trolley 709 is located. The nylon slide plate 709 provides a pivotal anchor point 710 for footplate 711, allowing the angle of the footplate to move freely relative the longitudinal axis L of the device. The footplate 711 may further comprise a removable heel pad 712, by adjusting the point of contact between the foot and the footplate the precise position though which a user has to exert force and thus the area of the user's anatomy which experiences pressure can be adjusted. Thus, when the removable heel pad 712 is absent, the device is driven by pressure through the ball of the user's foot and there is no pressure on the user's heel. Hence, the apparatus is operable without the need for a foot to be flat on the footplate i.e. it avoids pressure going through the heel portion. When the heel pad 712 is present, pressure is exerted through the user's heel via the removable heel pad into the footplate 711 of the device.

A calf support 713 is adjustably connected to the footplate 711. The calf support is molded to reflect the anatomical shape of a user's calf to provide an ergonomic support to ensure that unsupervised patients maintain their leg in the correct orientation when utilizing the device. Both the footplate 711 and calf support 713 are lined in foam or soft material to aid the comfort of the user. The angle between the footplate 711 and calf support 713 is adjustable via knob 714 so that the angle of the ankle in said foot and calf support to account for the varying degree of flexibility each user has in their ankle joint. Counter clockwise movement of knob 714 reduces the angle between the footplate and the calf support 713, whilst clockwise rotation of knob 714 increases the angle between the footplate and the calf support 713.

Anchor point 710 also joins the nylon slide plate or trolley 709 bearing the footplate 711 and calf support 713 to a connecting member in the form of steel cable 715. Steel cable 715 runs along a part of the length of the body of the device 701 over and around a wheel (see W in FIG. 8) to anchor the cable to a plurality of springs which provide variable resistance and form the inner workings of the device discussed in detail in FIG. 9.

The resistance of the device and thus the energy required to be exerted by a user pushing though the footplate 711 is adjusted through resistance switches 716 located on the upper surface of the first end 702 of the body of the device 701. A spring-loaded release lever 717 is also provided to disengage the bed end stop (FIG. 8; 803) when the device is no longer in use. The outer limit 720 of the bed end stop is visible in retracted position in FIG. 7.

The number of full leg extensions made is recorded by a digital or manual counter 718. Whilst an end stop clamp 719 is provided to limit the retraction of nylon slide plate or trolley 709 and thus restrict the extent of the user's movement when using the device.

Figure 8:
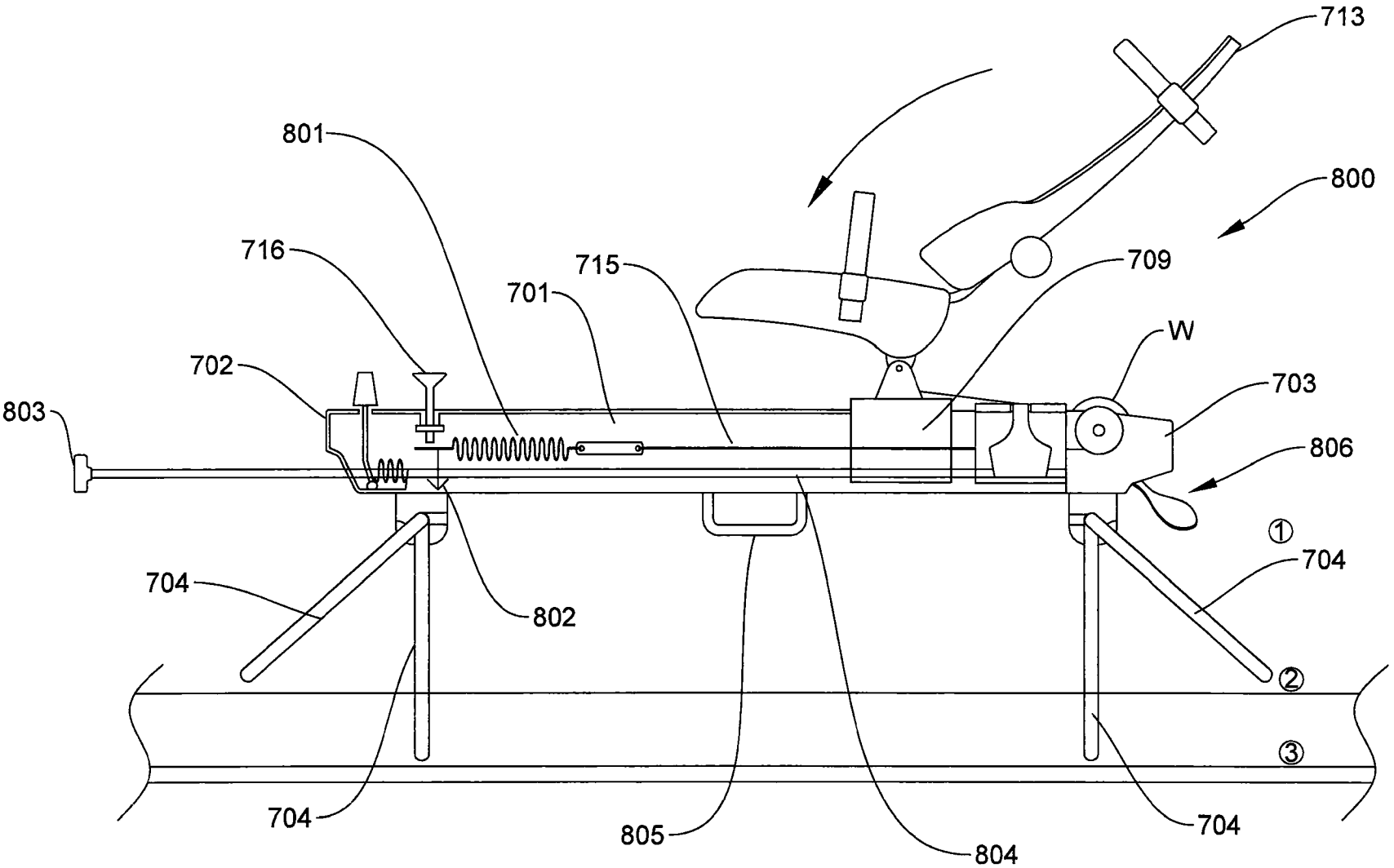
FIG. 8 is a partial cross section of a side view of a second embodiment of the present invention.

FIG. 8 illustrates a partial cross-sectional view 800 in accordance with the second embodiment of the present invention. Like numerals denote like parts. The elongate body of the device 701 having first 702 and second 703 ends houses steel cable 715 which is wound around wheel W and attached to a plurality of steel tension springs 801 naturally biased to retract and to pull the steel cable 715 towards themselves. The number of springs 801 engaged is determined by the number of organ stops 716 engaged on the surface of the apparatus. No physical user intervention with the resistance medium. When pressed down the organ stop engages the central aperture of the spring trapping it between the organ stop 716 and the lower surface 802 of the elongate body 701 in the direction of the arrow shown. In moving downwardly, the tension spring is in mechanical connection with the steel wire 715 increasing the resistance required by the user to move the trolley 709 towards the first end 702 of the apparatus.

The legs of the apparatus 704 are moveable between first (1), second (2) and third (3) orientations as determined by the height of the ground level or surface the device is being used upon. In use, a bed end stop 803, which comprises a pole 804 extending along the inner length of the device provides stability allowing the device to rest against a bed footboard or headboard when used on a bed.

When not in use the adjustable calf support 713 can be folded forward in the direction of the arrow for storage. The device further comprises a carry handle 805 on its underside so that the device can be carried and a hanging loop 806 for hanging the device.

Figure 9:
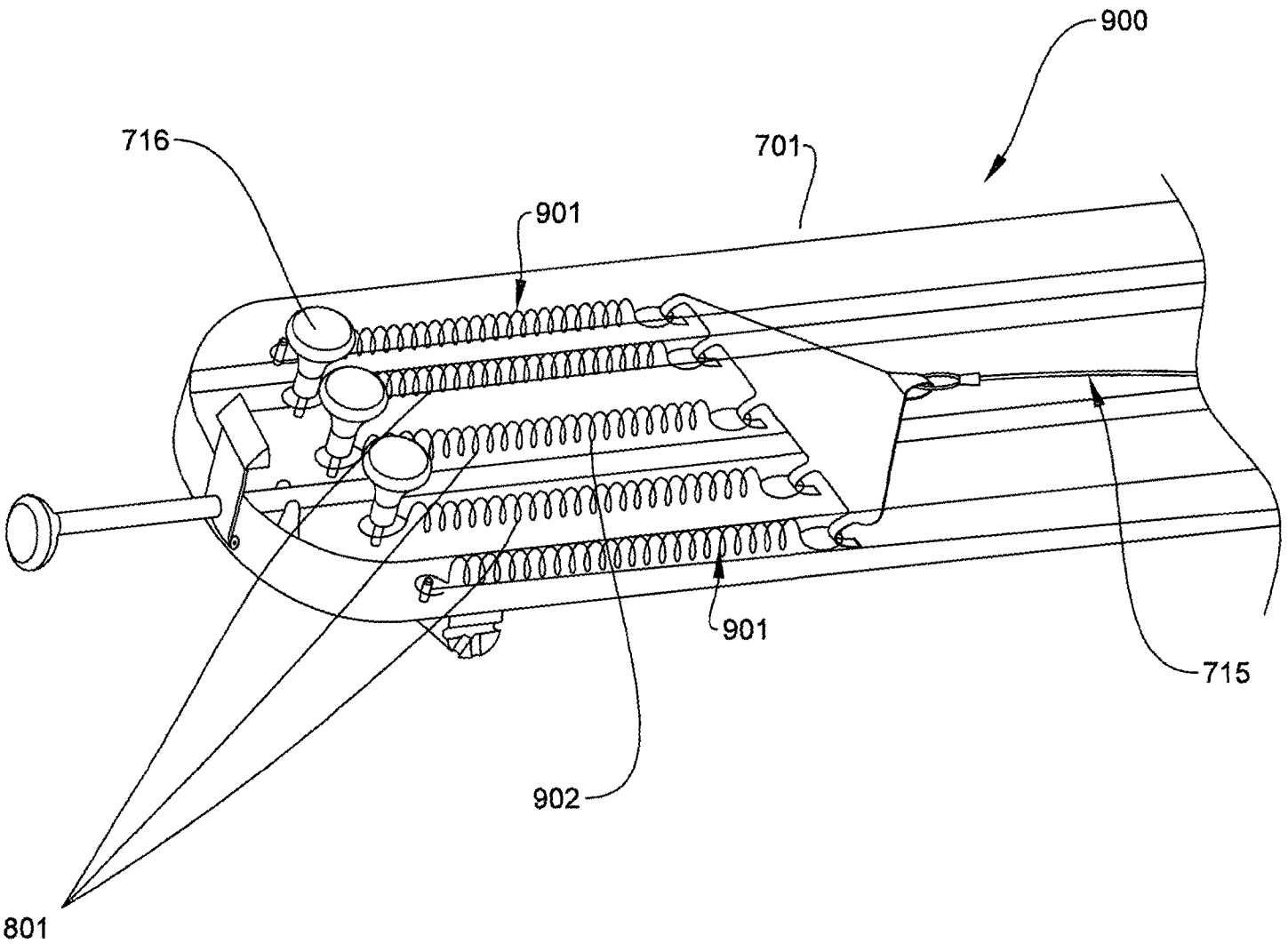
FIG. 9 is a partial cross section of a partial perspective view of a second embodiment of the present invention.

FIG. 9 herein shows a cross section 900 of a partial perspective view of the second embodiment of the present invention. The elongate body 701 is shown in partial cut through. Multiple steel coiled tension springs 801 are shown. The outermost two springs 901 are the weakest tension springs. These are in permanent attachment to the steel cable 715. The inner 3 springs 902 are engaged by depressing the relevant organ stop 716 and each offer differing and graduated levels of resistance.

Figure 10:
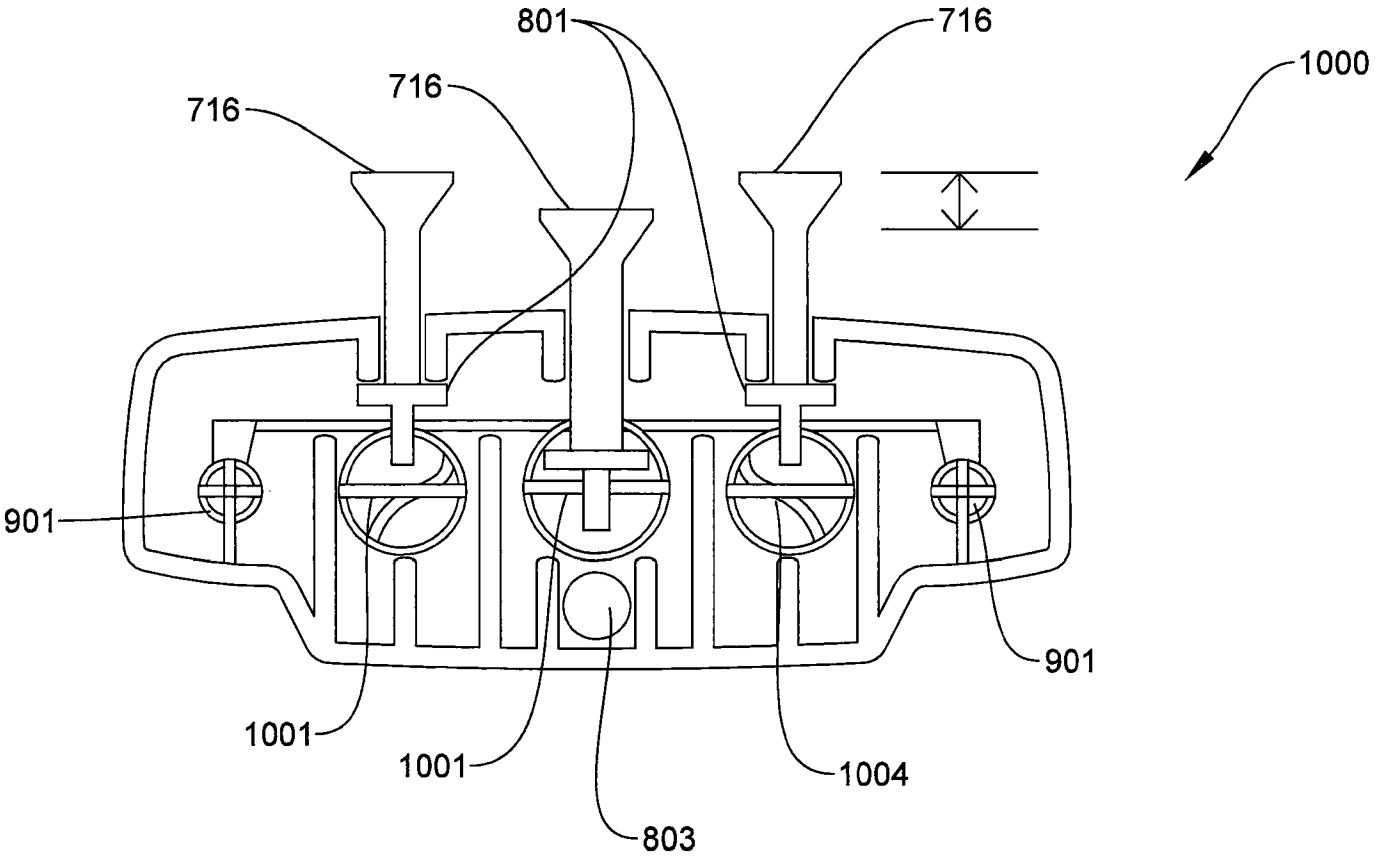
FIG. 10 is a vertical cross section of the organ stops according to a second embodiment of present invention.

The organ stop structure 1000 is shown in vertical cross section in FIG. 10. The bed end pole 803 running through the device and the two outer springs 901 which are permanently attached to the trolley are visible in this cross section.

Each organ stop 716 is coupled to the loop end 1001 of a steel spring 801 so that when the corresponding knob, stop or plunger 716 is depressed and pushed downwardly a lower end of the knob, stop or plunger engaged with the central aperture of the loop end of the spring(s) so that the springs are engaged thus increasing the tension experienced by the sliding element, increasing the resistance required by a user to move the footplate of the device in a forward motion.

Figure 11:
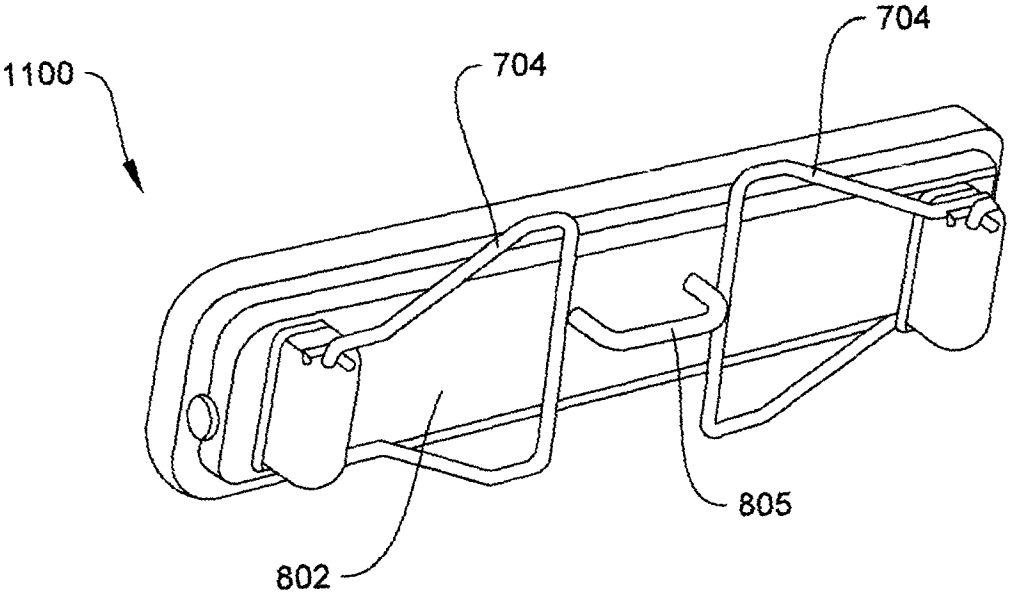
FIG. 11 is a representative illustration of the folding nature of the device in accordance with a second embodiment of the present invention.

Referring to FIG. 11 herein there is shown a representative illustration to demonstrate the folding nature of the apparatus in accordance with a second embodiment of the present invention. The apparatus 1100 has two legs 704 folded upwardly into the underside 802 of the device 1100. A carry handle 805 on the underside of the device allows the device to be carried once said legs 704 are in a folded configuration.

Figure 12:
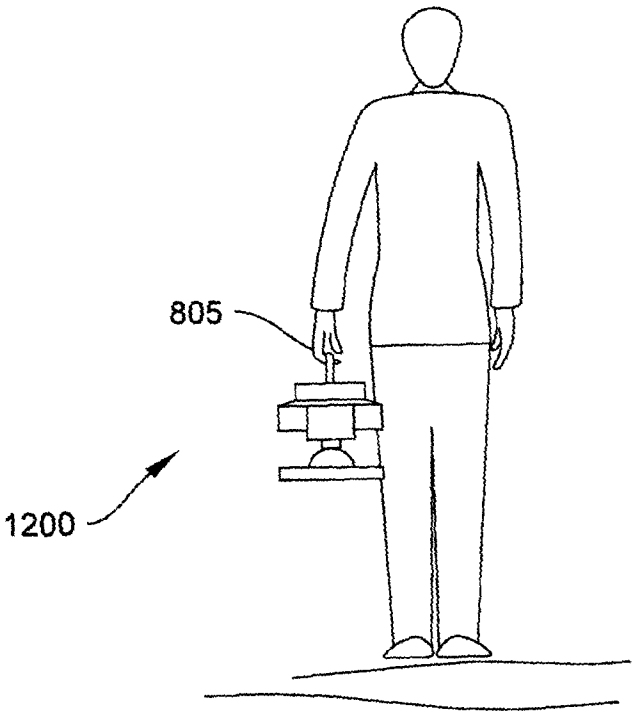
FIG. 12 is a representative illustration of the portable nature of the device in accordance with a second embodiment of the present invention.

Referring to FIG. 12 herein there is shown a representative illustration in accordance with a second embodiment to demonstrate the portable nature of the apparatus. The apparatus 1200 is carried by handle 805 located on the underside of the apparatus and the calf and footplate have been folded inwardly into the body of the apparatus for ease of transport.

Figure 13:
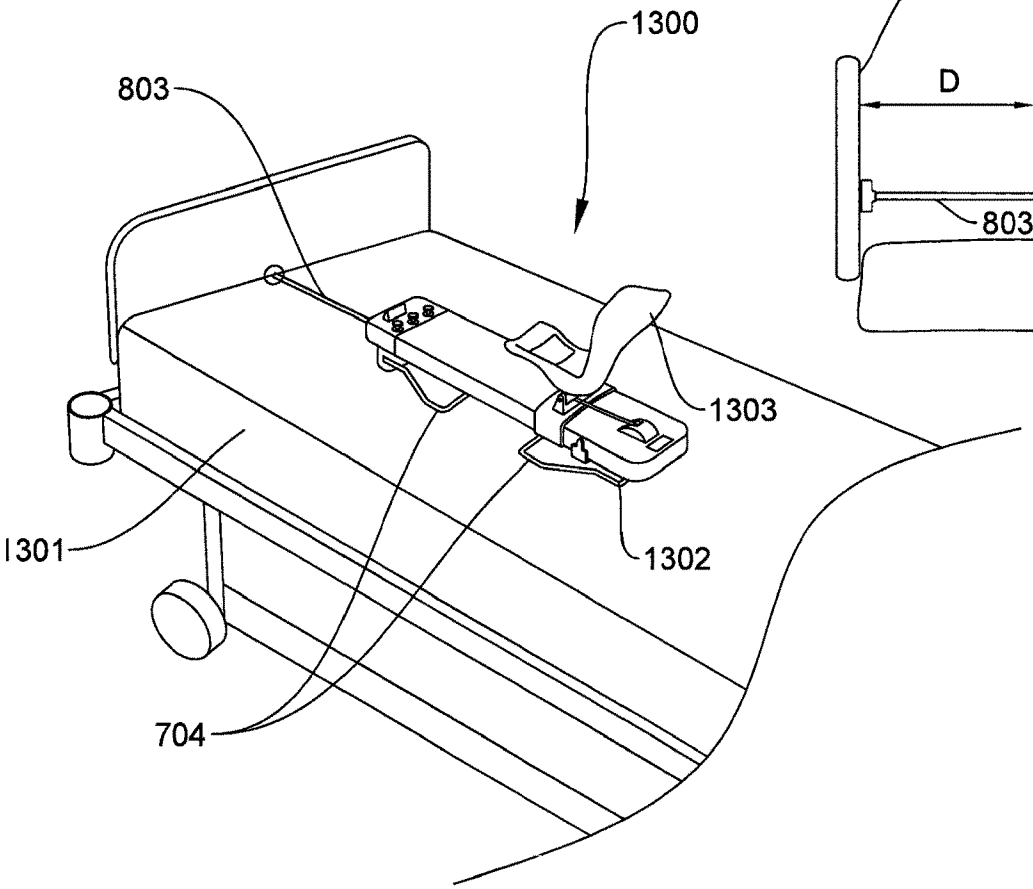
FIG. 13 is a perspective view of a device in accordance with a second embodiment of the present invention in use on a bed.

Referring to FIG. 13 herein there is shown a representative perspective illustration of a device 1300 in accordance with a second embodiment of the present invention in use on a bed 1301. The device 1300 has pivotal legs 704 folded inwardly so that the outer limit of the device in contact with the bed 1301 is the curved underside 1302 of the device 1300 to which the legs 704 are pivotally mounted. The curved underside may be coated in rubber to enhance friction and prevent the device from slipping. A bed stop 803 extends from a first end of the device 1300 and prevents the device from moving forward when a user extends the footplate and calf support forming the 'leg rest' 1303 forward towards the bed stop end of the device.

Figure 14:
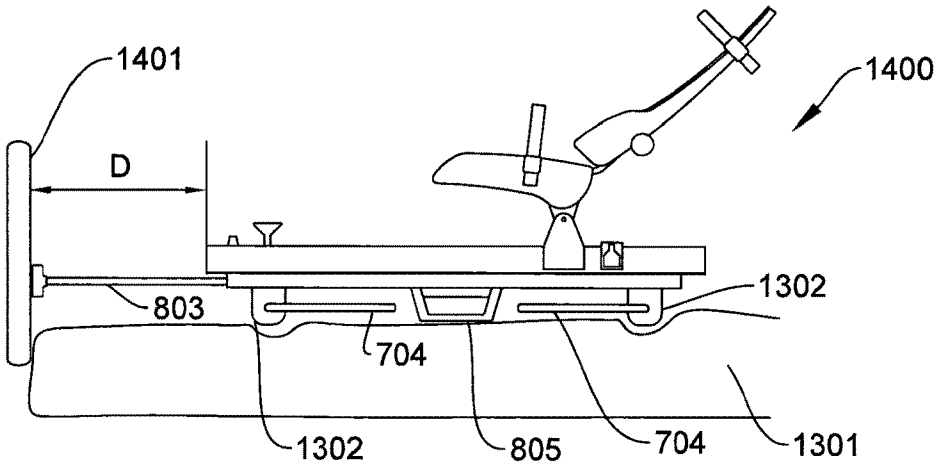
FIG. 14 is a side illustration of a device in accordance with a second embodiment of the present invention in use on a bed.

Referring to FIG. 14 herein there is shown a representative side illustration of a device 1400 in accordance with a second embodiment of the present invention in use on a bed 1301. The device 1400 has pivotal legs 704 folded inwardly so that the outer limit of the device and the carrying handle 805 are both in contact with the bed 1301 as is the curved underside 1302 of the device 1400 to which the legs 704 are pivotally mounted. The curved underside may be coated in rubber to enhance friction and prevent the device from slipping. An adjustable bed stop 803 extends from a first end of the device towards the bed footboard 1401 at variable distance D as required by the user. The bed stop 803 prevents the device from moving forward when a user extends the footplate and calf support of the device 1400 in a forward direction.

Figure 15:
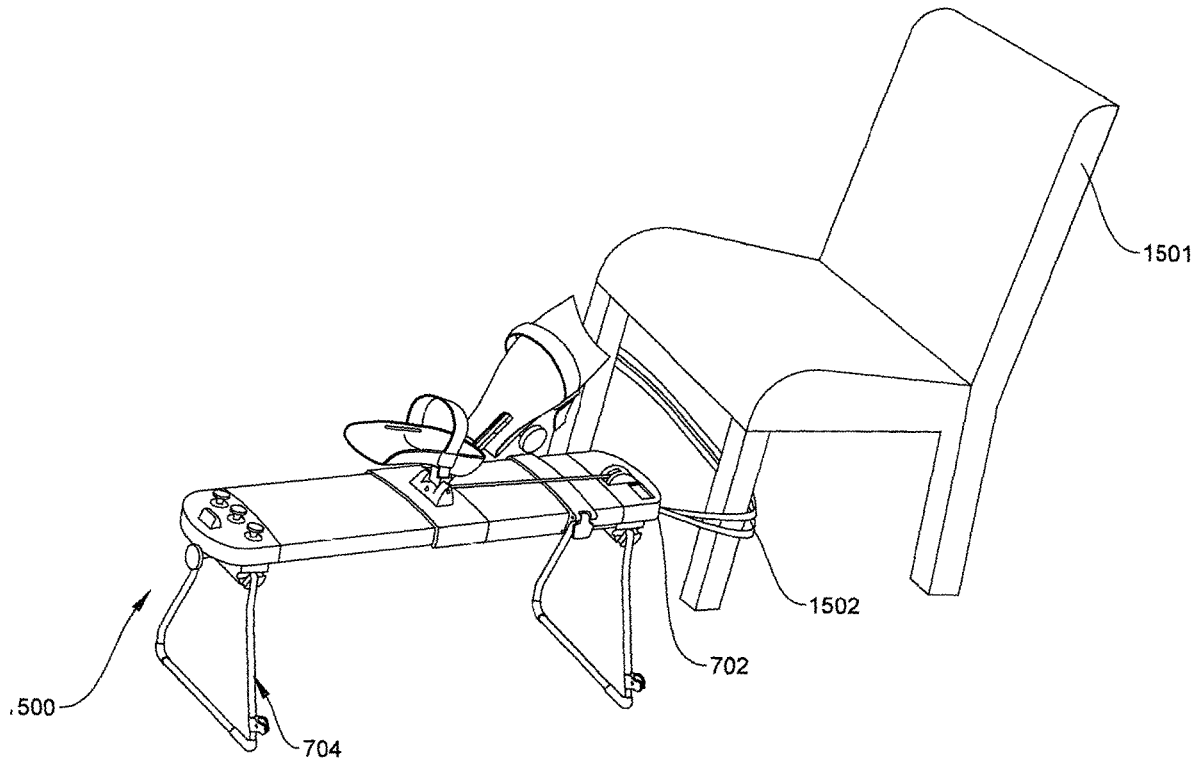
FIG. 15 is a representative perspective illustration of a single device in accordance with a second embodiment of the present invention for use by a seated individual.

Referring to FIG. 15 herein there is shown a representative perspective illustration of a single device 1500 in accordance with a second embodiment of the present invention for use by a seated individual. A first end 702 of the device 1500 is shown strapped to a chair 1501 by belt anchor 1502. The pivotal legs 704 are fully extended so that the device is raised from floor level.

Figure 16:
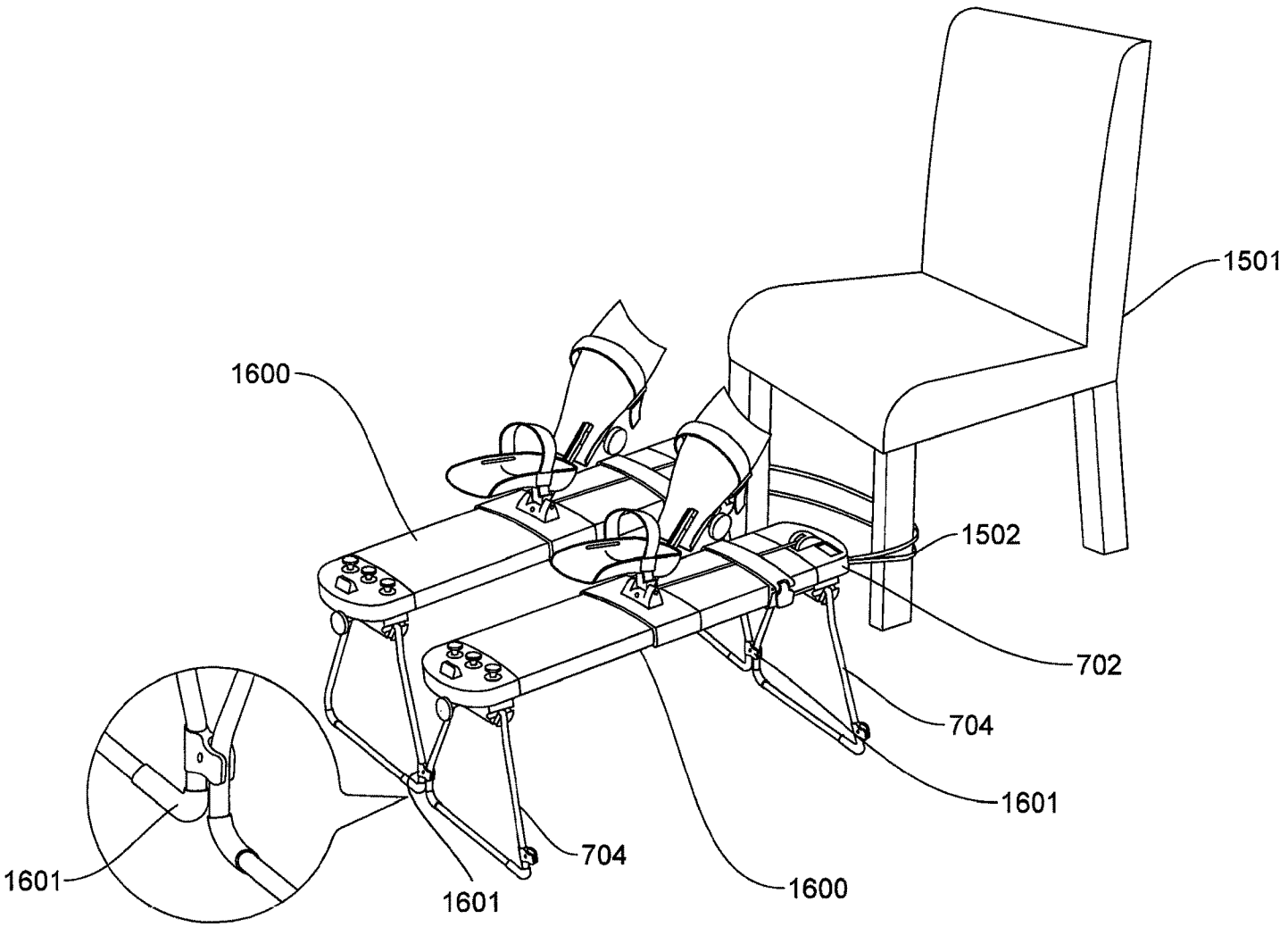
FIG. 16 is a representative perspective illustration of two conjoined devices in accordance with a second embodiment of the present invention for use by a seated individual.

Referring to FIG. 16 herein there is shown a representative perspective illustration of two conjoined devices 1600 in accordance with a second embodiment of the present invention for use by a seated individual. First ends 702 of the respective devices 1600 are shown strapped to a chair 1501 by belt anchors 1502. The pivotal legs 704 of each device 1600 are fully extended so that the devices are raised from floor level. The devices 1600 are connected by plastic joining clips 1601 to allow the devices to be operated simultaneously without separating.

Figure 17:
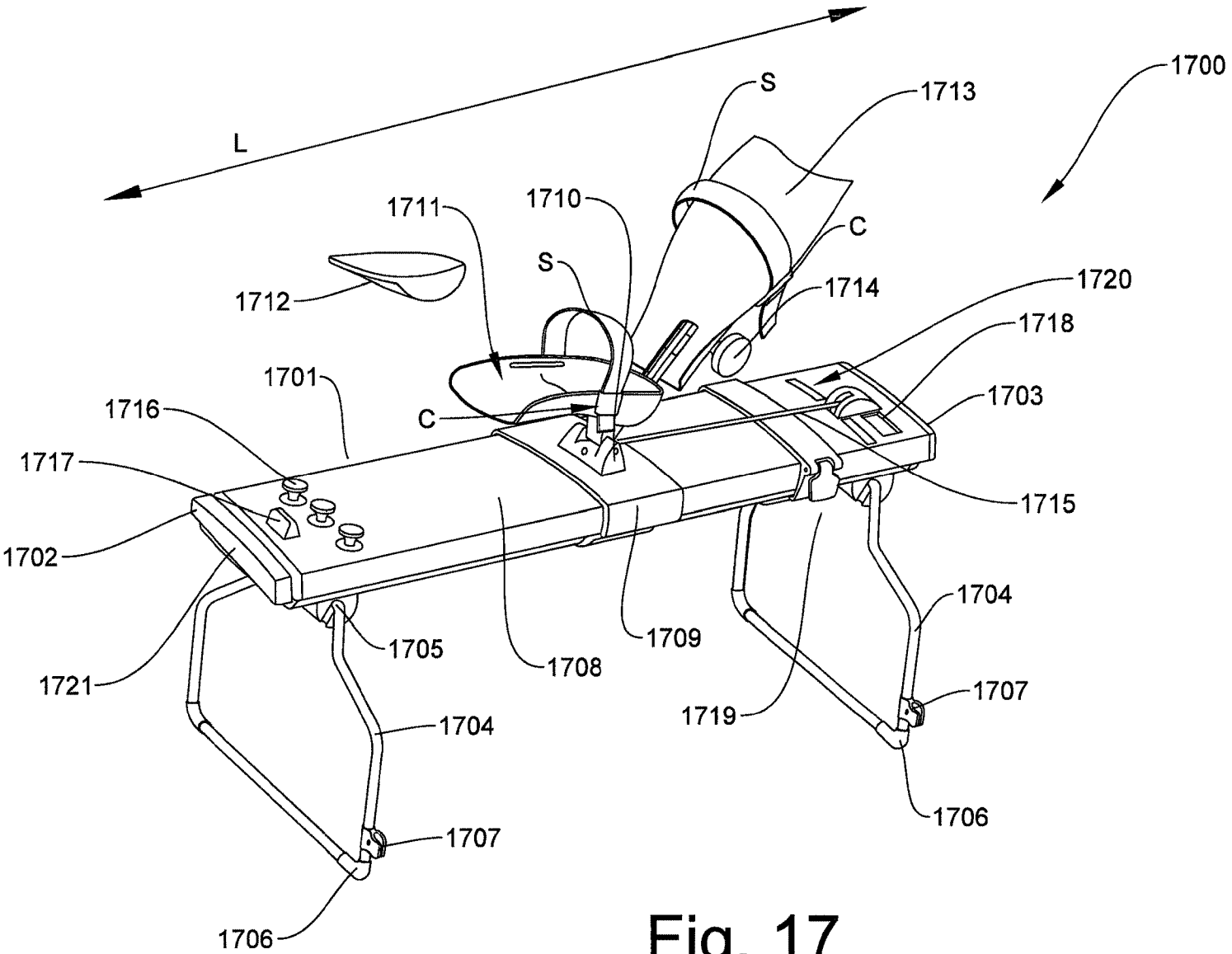
FIG. 17 is a perspective view of a third embodiment of the present invention.

Referring to FIG. 17 herein there is shown a perspective view of a third embodiment of the apparatus in accordance with the present invention. The apparatus 1700 comprises an elongate body 1701 having first 1702 and second 1703 ends. The apparatus is mounted on a pair of legs 1704 in adjustable attachment to the body of the device 1701 about pivot points 1705. The legs have stoppers or feet 1706 made from a thermoplastic elastomer (TPE) plastic to increase friction between the apparatus and the device on which it is placed to prevent the apparatus from slipping. The legs may further comprise joining clips 1707 which permit two individual apparatus 1700 to be joined together or may assist in joining the device to an anchor point for stability e.g. a chair. The legs are foldable beneath the device so that it can be used folded flat for storage.

The upper surface of the elongate body 1701 is an aluminium extruded body 1708 over which an aluminium slide plate or trolley 1709 is located. The aluminium slide plate 1709 provides a pivotal anchor point 1710 for footplate 1711, allowing the angle of the footplate to move freely relative the longitudinal axis L of the device. The footplate 1711 may further comprise a removable heel pad 1712, by adjusting the point of contact between the foot and the footplate the precise position though which a user has to exert force and thus the area of the user's anatomy which experiences pressure can be adjusted. Thus, when the removable heel pad 1712 is absent, the device is driven by pressure through the ball of the user's foot and there is no pressure on the user's heel. Hence, the apparatus is operable without the need for a foot to be flat on the footplate i.e. it avoids pressure going through the heel portion. When the heel pad 1712 is present, pressure is exerted through the user's heel via the removable heel pad into the footplate 1711 of the device.

A calf support 1713 is adjustably connected to the footplate 1711. The calf support is molded to reflect the anatomical shape of a user's calf to provide an ergonomic support to ensure that unsupervised patients maintain their leg in the correct orientation when utilizing the device. Both the footplate 1711 and calf support 1713 are lined in foam or soft material to aid the comfort of the user. The angle between the footplate 1711 and calf support 1713 is adjustable via adjusting means 1714 so that the angle of the ankle in said foot and calf support to account for the varying degree of flexibility each user has in their ankle joint. Counterclockwise movement of adjusting means 1714 reduces the angle between the footplate and the calf support 1713, whilst clockwise rotation of knob 1714 increases the angle between the footplate and the calf support 1713. The user's foot and leg are held in position by silicone straps 'S' attached to the footplate 1711 and calf support 1713 respectively. The strap bindings 'S' are adjusted by a CAM locks 'C' to ensure the user's foot and leg are held in place in the device.

Anchor point 1710 also joins the aluminium slide plate or trolley 1709 bearing the footplate 1711 and calf support 1713 to a connecting member in the form of steel cable 1715. Steel cable 1715 runs along a part of the length of the body of the device 1701 over and around a wheel (see W in FIG. 19) to anchor the cable to a plurality of springs which provide variable resistance and form the inner workings of the device discussed in detail in FIG. 18.

The resistance of the device and thus the energy required to be exerted by a user pushing though the footplate 1711 is adjusted through resistance switches 1716 located on the upper surface of the first end 1702 of the body of the device 1701. A spring-loaded release lever 1717 is also provided to disengage the bed end stop when the device is no longer in use.

The number of full leg extensions made is recorded by a digital counter 1718. Whilst an end stop clamp 1719 is provided to limit the retraction of aluminium slide plate or trolley 1709 and thus restrict the extent of the user's movement when using the device. The device 1700 further includes a start line 1720 to denote the beginning position for the aluminium trolley 1709 when in use by a patient.

In contrast to embodiment two, the device has a substantially rectangular flat end piece which forms an elongate bed stop 1721 and is shown in retracted configuration in FIG. 17. A further difference in third embodiment of the invention is that the foldable leg 1704 also provides a carry handle when the device is being transported.

Figure 18:
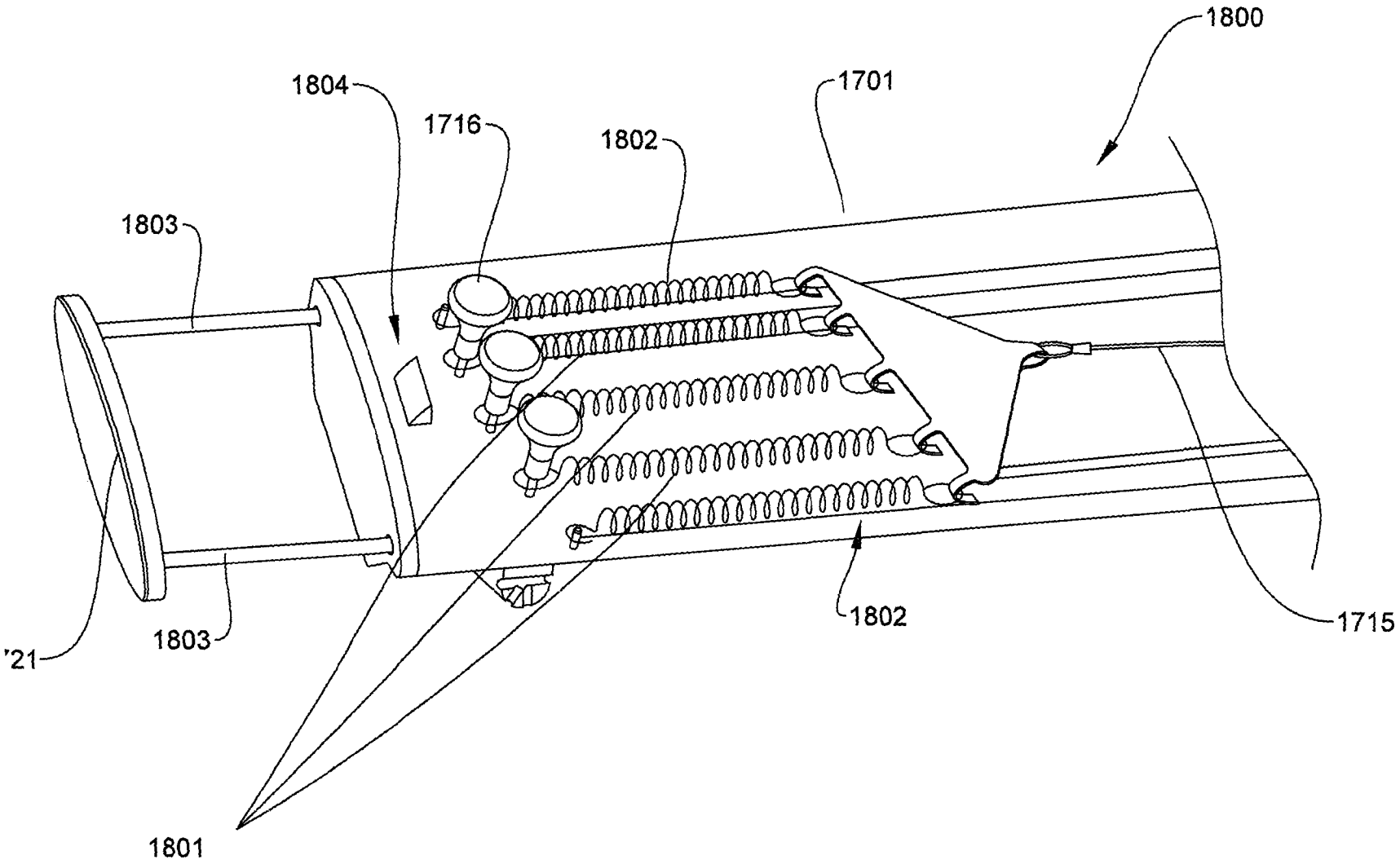
FIG. 18 is a partial cross section of a partial perspective view of the device in accordance with a third embodiment of the present invention.
Figure 19A:
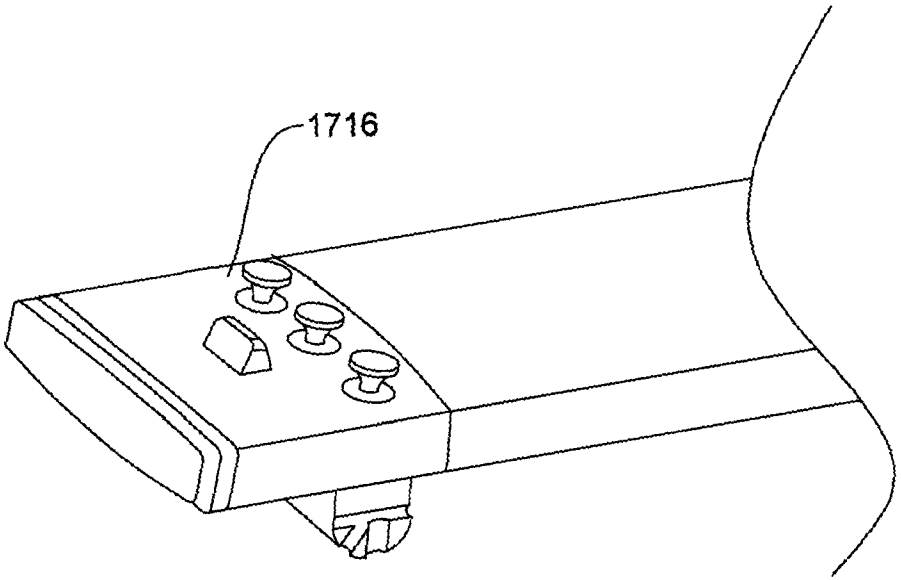
FIGS. 19*a-c* illustrate the organ stop feature in accordance with the third embodiment of the invention.

FIG. 18 herein shows a cross section 1800 of a partial perspective view of the device in accordance with a third embodiment of the present invention. The elongate body 1701 is shown in partial cut through. Multiple steel coiled tension springs 1801 are shown. The outermost two springs 1802 are the weakest tension springs. These are in permanent attachment to the steel cable 1715. The inner 3 springs 1801 are engaged by depressing the relevant organ stop 1716 and each offer differing and graduated levels of resistance.

The bed end stop 1721 comprises two elongate poles 1803 which run through the body of the device 1701. Having two supports for the end stop provide greater stability to the device in use and also prevent the device from twisting. A spring-loaded release lever 1804 is operable to disengage the bed end stop and allow the rods 1803 to retract within the body of the device. The trolley 1709 must be at the start line 1720 before adjusting the resistance.

Figure 19B:
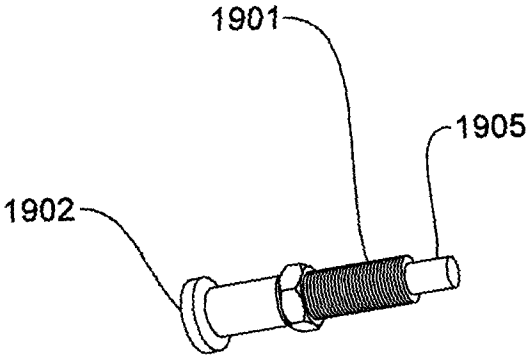
Figure 19C:
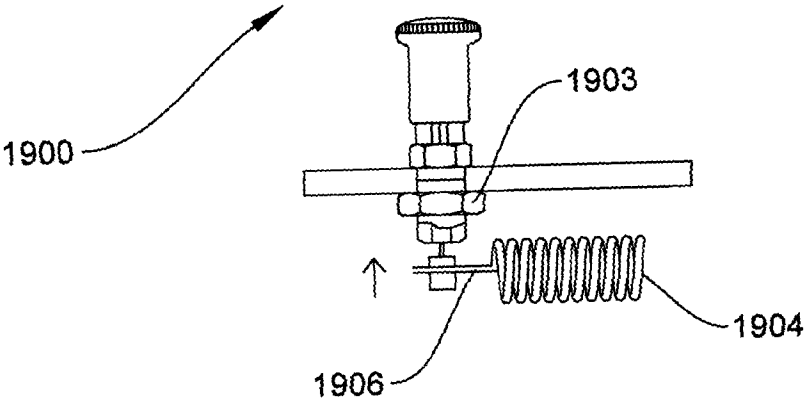

Greater details of the organ stop arrangement of the third embodiment is illustrated in FIGS. 19*a-c*, 1900. Each organ stop 1716 is located in a vertical orientation protruding from the longitudinal body 1701 of the device. The organ stops comprise standard plungers as shown in FIG. 19*b* having a threaded portion 1901 and an enlarged flat portion 1902 which provides a gripping region. Referring to FIG. 19*c* the threaded portion 1901 of the plungers are operable to engage with a correspondingly threaded screw 1903 located within the device body. The plungers are pushed downwardly to engage the corresponding spring 1904 beneath, a loop end 1906 of steel spring 1904, so that when the corresponding plunger 1716 is depressed and pushed downwardly a lower end of the knob, stop or plunger engaged with the central aperture of the loop end of the spring(s) so that the springs are engaged. The spring 1904 which is engaged determines the tension and force required by the user to operate the device. To disengage the plunger, the knob-like gripping portion 1902, which may have undulations on it to aid gripping, is lifted upwardly and rotated 90 degrees to latch the plunger in a disengaged position in which the narrow-tapered end of the plunger 1905 sits above the screw 1903.

Figure 20:
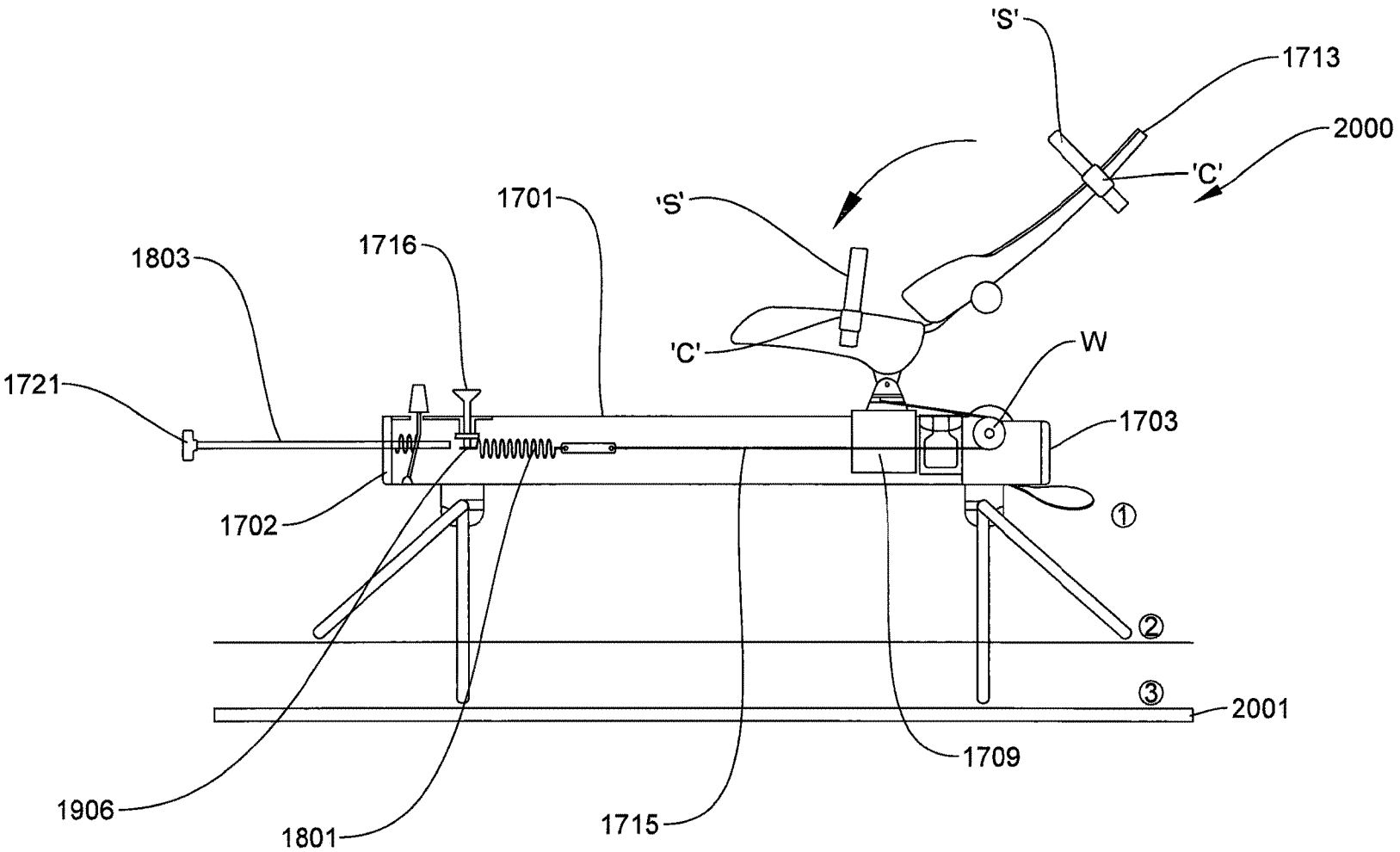
FIG. 20 is a partial cross section of a side view according to a third embodiment of the present invention.

Referring to FIG. 20 herein there is shown a partial cross-sectional view 2000 in accordance with the third embodiment of the present invention. Like numerals denote like parts. The elongate body of the device 1701 has first 1702 and second 1703 ends and the body 1701 houses steel cable 1715 which is wound around wheel W and attached to a plurality of steel tension springs 1801 naturally biased to retract and to pull the steel cable 1715 towards themselves. The number of springs 1801 engaged is determined by the organ stop 1716 engaged on the surface of the apparatus. When pressed down the organ stop engages with the central aperture of the loop end 1906 of the spring to increase the resistance required by the user to move the trolley 1709 towards the first end 1702 of the apparatus.

Figure 21:
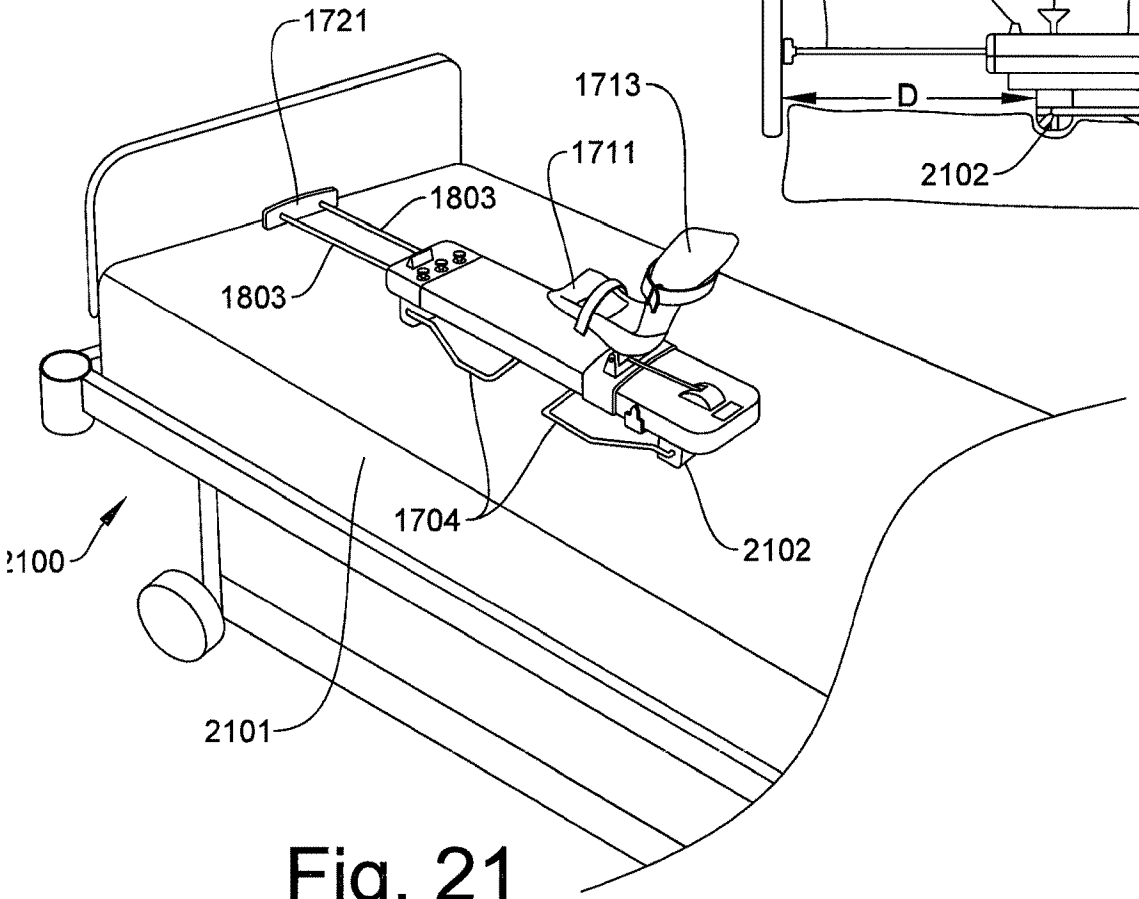
FIG. 21 is a perspective view of a device in accordance with a third embodiment of the present invention in use on a bed.

Referring to FIG. 21 herein there is shown a representative perspective view 2100 of a device in accordance with a third embodiment of the present invention in use on a bed 2101. The device has pivotal legs 1704 folded inwardly so that the outer limit of the device in contact with the bed 2101 is the curved underside 2102 of the device to which the legs 1704 are pivotally mounted.

The legs have stoppers or feet 1706 shown in FIG. 17 made from a thermoplastic elastomer (TPE) plastic to increase friction between the apparatus and the device on which it is placed to prevent the apparatus from slipping. The legs may further comprise joining clips 1707 which permit two individual apparatus 1700 to be joined together or may assist in joining the device to an anchor point for stability e.g. a chair. The legs are foldable beneath the device so that it can be used folded flat for storage.

Referring to FIG. 21 the curved underside 2102 is coated in rubber to enhance friction and prevent the device from slipping. The bed stop 1721 extends from a first end of the device 2100 and prevents the device from moving forward when a user extends the footplate 1711 and calf support 1713 which form a 'leg rest' towards the bed stop end of the device.

Figure 22:
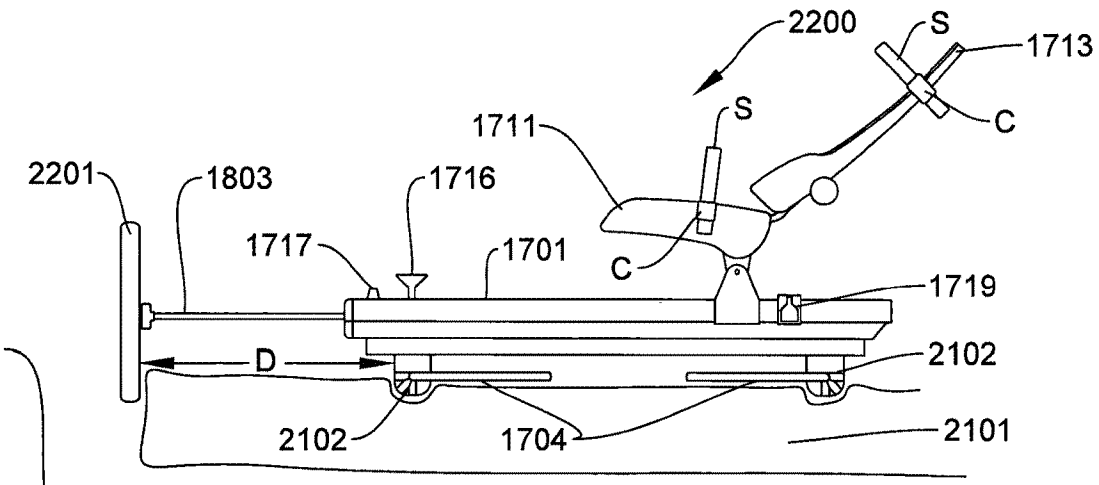
FIG. 22 is a side illustration of a device in accordance with a third embodiment of the present invention in use on a bed.

Referring to FIG. 22 herein there is shown a representative side illustration 2200 of a device in accordance with a third embodiment of the present invention in use on a bed 2101. The device has pivotal legs 1704 folded inwardly so that the curved underside 2102 of the device to which the legs 1704 are pivotally mounted is in contact with the bed 2101. The curved underside is to be coated in rubber to enhance friction and prevent the device from slipping. An adjustable bed stop 1803 extends from a first end of the device towards the bed footboard 2201 at variable distance D as required by the user. The bed stop 1803 prevents the device from moving forward when a user extends the footplate 1711 and calf support 1713 of the device in a forward direction.

Figure 23:
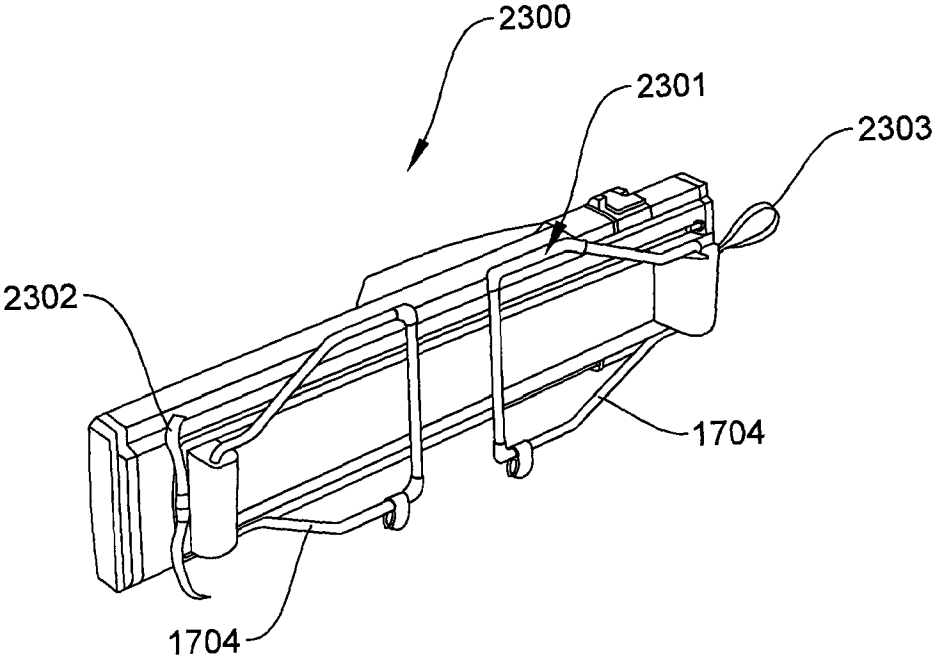
FIG. 23 is a representative illustration of the folding nature of the device in accordance with a third embodiment of the present invention.

Referring to FIG. 23 herein there is shown a device in accordance with a third embodiment of the present invention in folded configuration for storage and transport 2300. The apparatus has two legs 1704 folded upwardly into the underside of the device. One of the legs 1704 has a coating 2301 of thermoplastic elastomer (TPE) plastic to increase friction between the apparatus and to provide a gripping area and handle for carrying the device once the legs 1704 are in a folded configuration.

Figure 24:
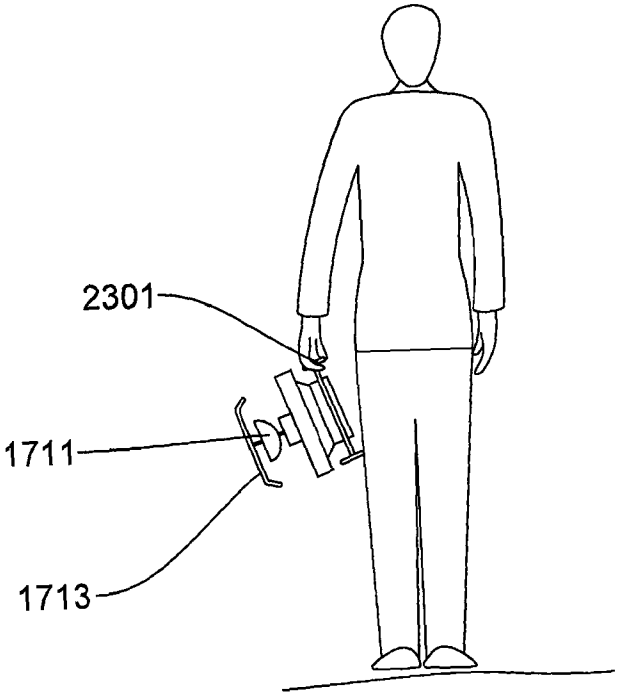
FIG. 24 is a representative illustration of the portable nature of the device in accordance with a third embodiment of the present invention.

Referring to FIGS. 23 and 24 herein there is shown a device in accordance with a third embodiment of the invention. The apparatus is carried by handle 2301 which is a region of one of the supporting legs 1704. The calf 1713 and footplate 1711 have been folded inwardly into the body of the apparatus for ease of transport. An anchor strap 2302 is shown which can be used to secure the device to a chair when used in an upright position. A hanging loop 2303 can be used to aid hung storage of the device.

Figures 25A, 25B, 25C:
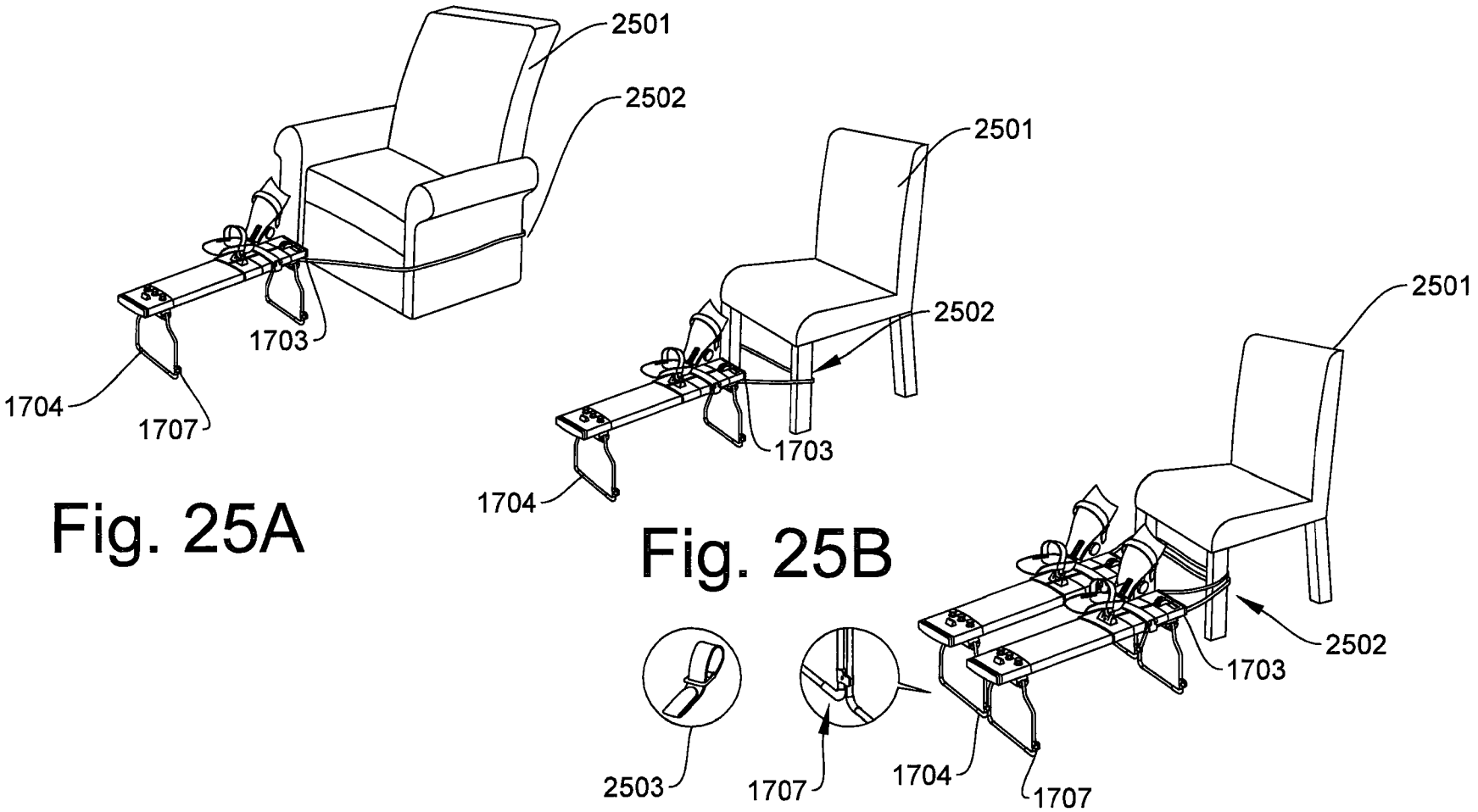
FIGS. 25*a* and *b* are perspective illustrations of a single device in accordance with a third embodiment of the present invention for use by a seated individual.
FIG. 25*c* is a perspective illustration of two conjoined devices in accordance with a third embodiment of the present invention for use by a seated individual.

Referring to FIGS. 25*a* and 25*b* there are shown perspective illustrations of a single device in accordance with a third embodiment of the present invention for use by a seated individual. An end 1703 of the device is shown strapped to a chair 2501 by belt anchor 2502. The pivotal legs 1704 are fully extended so that the device is raised from floor level.

An extra-long belt anchor, approximately 2-3 meters in length 2503 may be used to secure the device around a large comfortable chair or may be 1-2 meters for securing a single device to an upright sturdy chair e.g. a dining chair. The belt anchor is made of hygienic gloss thermoplastic polyurethane.

Referring to FIG. 25*c* there is shown a perspective illustration of two conjoined devices in accordance with a third embodiment of the present invention for use by a seated individual. Ends 1703 of the respective devices are shown strapped to a chair 2501 by belt anchors 2502. The pivotal legs 1704 of each device are fully extended so that the devices are raised from floor level. The devices are connected by plastic joining clips 1707 the illustration, shown to allow the devices to be operated simultaneously without separating. Alternatively, the devices may be joined by Velcro strapping 2503.

Figure 26B:
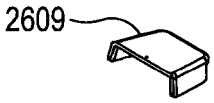
FIGS. 26*b* and 27*b* show the heel support in accordance with the configurations shown in FIGS. 26*a* and 27*a*.
Figure 26A:
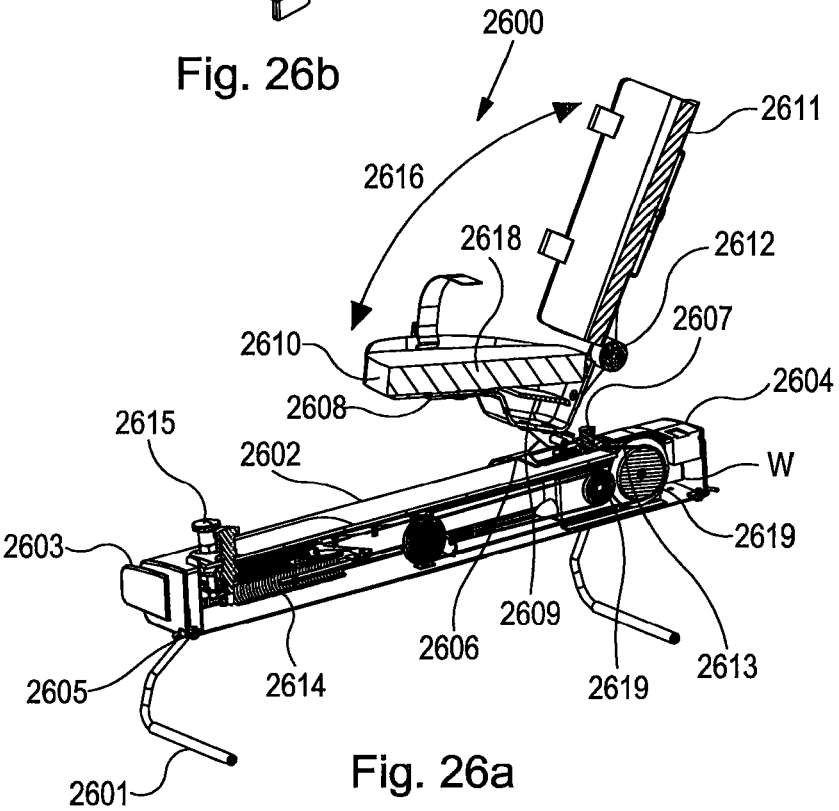
FIG. 26*a* is a side cross sectional view of a device in accordance with the fourth embodiment of the invention, showing a heel support in situ.
Figure 27B:
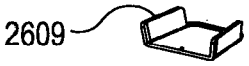
Figure 27A:
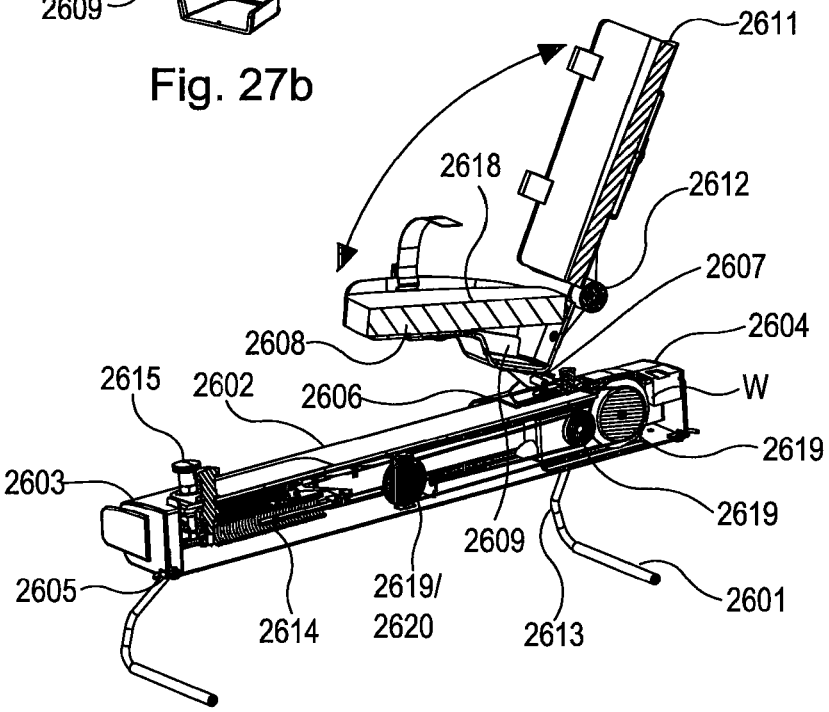
FIG. 27*a* is a side cross sectional view of a device in accordance with the fourth embodiment of the invention, showing a heel support in stowed location such that a user does not exert pressure through their heel when using the device.

Referring to FIGS. 26*a* and 27*a* herein there is shown a cutaway perspective view of a device 2600 in accordance with a fourth embodiment of the present invention. The device is shown in an orientation suitable for use by a seated individual. The device 2600 comprises pivotal legs 2601 extending substantially perpendicular to the longitudinal body of the device 2602 which has first 2603 and second 2604 ends. The body 2602 of the device is mounted on the pair of legs 2601 which are adjustably attachment to the body of the device 2602 about pivot points 2605. The legs are foldable beneath the device so that it can be used folded flat for storage or for use on a bed.

The upper surface of the elongate body 2602 is a molded plastic shell of polyurethane or an aluminium extrusion over which a nylon slide plate or trolley 2606 is located. All moving parts are located within the body 2602 of the device, to provide a smooth other shell which enhances the slidability of the device. Further the containment of all moving parts within the device prevents the collection of skin debris within said moving parts and minimizes the risk of cross contamination between patients allowing the cover to be cleaned effectively and the device to be shared by several users.

A footplate 2608 is mounted via pivotal anchor point 2607 to the body of the device 2602 by a gantry or nylon slide plate 2606 which can slide back and forth a distance of approximately 380 mm along the longitudinal body of the device. The pivotal anchor point 2607 for footplate 2608, allows the angle of the footplate to move freely relative the longitudinal axis L of the device. The footplate 2608 further comprises a removable heel support or pad 2609, which is a 'U' shaped block which sits within the footplate 2608. The outer limits of the 'U' shaped heel pad 2609 are in contact with the lower most portion of the footplate 2608 whilst the base of the 'U' provides a support to a cushioned insert 2610 located on the footplate 2608. When the heel pad 2609 is present in this orientation, pressure is exerted through the user's heel via the removable heel pad into the footplate 2608 of the device.

By adjusting the orientation of the heel insert 2609 the point of contact between the foot and the footplate the device which determined the contact point though which a user has to exert force and thus the area of the user's anatomy which experiences pressure can be adjusted. The heel support 2609 can be turned upside down to reduce the pressure on the user's heel. The removable heel support 2609 can be stowed in the footplate in as per FIG. 27 in an alternative configuration in which, the outer limits of the 'U' shaped piece are upwardly facing and the central portion of the 'U' is in contact with the footplate 2608 so that in order to operate the device a user must apply pressure to the ball of their foot and there is no pressure on the user's heel. Hence, the apparatus is operable without the need for a foot to be flat on the footplate i.e. it avoids pressure going through the heel portion. A foot cushion 2618 is provided to protect the user's heel from the edges of the heel support 2609. The heel support 2609 is tethered to stop it from becoming lost or detached form the apparatus. Referring to FIGS. 26*b* and 27*b* the heel support 2609 is shown in the respective supporting and non-supporting configurations, relative to the body 2602 of the apparatus.

A calf support 2611 is adjustably connected to the footplate 2608, together the calf support 2611 and footplate 2608 form a leg rest 2616. The angle between the footplate 2608 and the calf support 2611 is adjustable between 75° and 180°. The calf support is molded to reflect the anatomical shape of a user's calf to provide an ergonomic support to ensure that unsupervised patients maintain their leg in the correct orientation when utilizing the device. Both the footplate 2608 and calf support 2611 are lined in foam or soft material to aid the comfort of the user. The angle between the footplate 2608 and calf support 2611 is adjustable via adjustment means 2612 so that the angle of the ankle in said foot and calf support to account for the varying degree of flexibility each user has in their ankle joint. The angle between the footplate 2608 and the calf support 2611 is adjustable between 75° and 180°. Counterclockwise movement of the adjustment means which is a knob 2612 reduces the angle between the footplate 2608 and the calf support 2611, whilst clockwise rotation of knob 2612 increases the angle between the footplate and the calf support 2611.

Anchor point 2607 also joins the gantry or nylon slide plate 2606 bearing the footplate 2608 and calf support 2611 to a connecting member in the form of steel cable 2613. The gantry 2606 is tethered by the steel cable 2613 to a spring assembly (resistance means) inside the housing 2602. The steel cable 2613 runs along a part of the length of the body of the device 2602 over and around a wheel (see W) to anchor the cable to a plurality of springs 2614 which provide variable resistance and form the inner workings of the device analogous to the second embodiment of the invention discussed in detail in FIG. 9. The steel cable 2613 passes around 3 pulleys 2619 located within the housing 2602. The presence of three pulleys reduced the amount the springs need to extend by three-fold, to only 125 mm which means that the springs have to withstand a pull force that is three times as much as the greatest force applied on to the foot support by the user. This is the block and tackle principle. In this embodiment, there are three pulleys are assembled to form blocks, two of the pulleys are fixed and the third pulley 2620 moves with the movement of the gantry 2606 i.e. it moves with the load. The steel cable is threaded through the pulleys 2619/2620 to provide a mechanical advantage which amplifies the force required by the user to move the leg rest 2616.

The resistance of the device and thus the energy required to be exerted by a user pushing though the footplate 2608 is adjusted through resistance switches 2615 located on the upper surface of the first end 2603 of the body of the device 2602. Further features including the spring-loaded release lever, bed end stop and digital or manual counter as detailed in the second embodiment are also common to this embodiment.

Figure 28C:
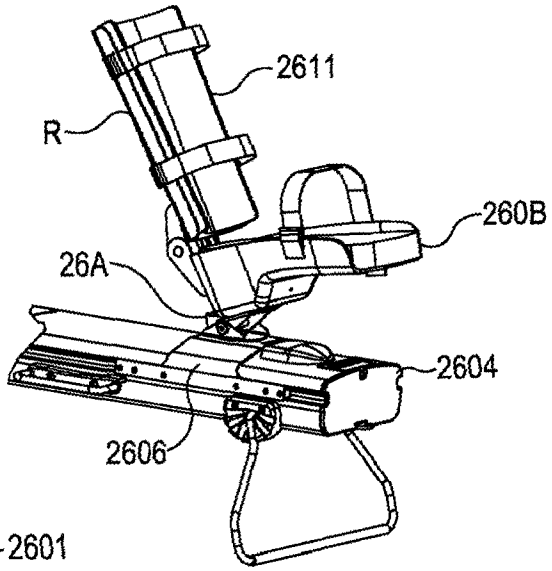
FIGS. 28*b* and 28*c* are partial perspective views of a device in accordance with the fourth embodiment of the invention, for use by a seated individual, showing the rotability of the foot rest in an first (FIG. 28*a*), intermediate (FIG. 28*b*) and second configuration (FIG. 28*c*).
Figure 28B:
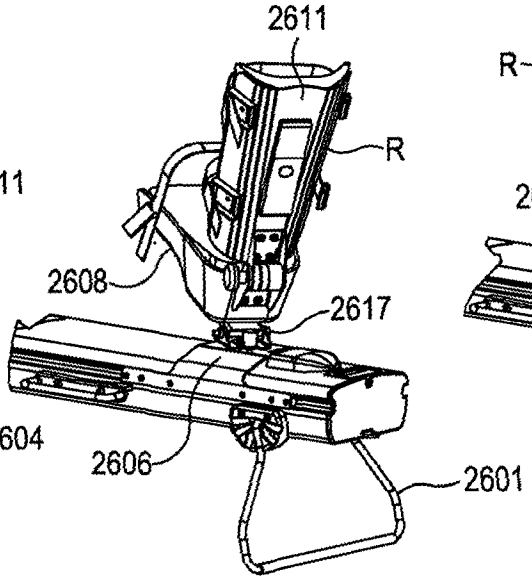
Figure 28A:
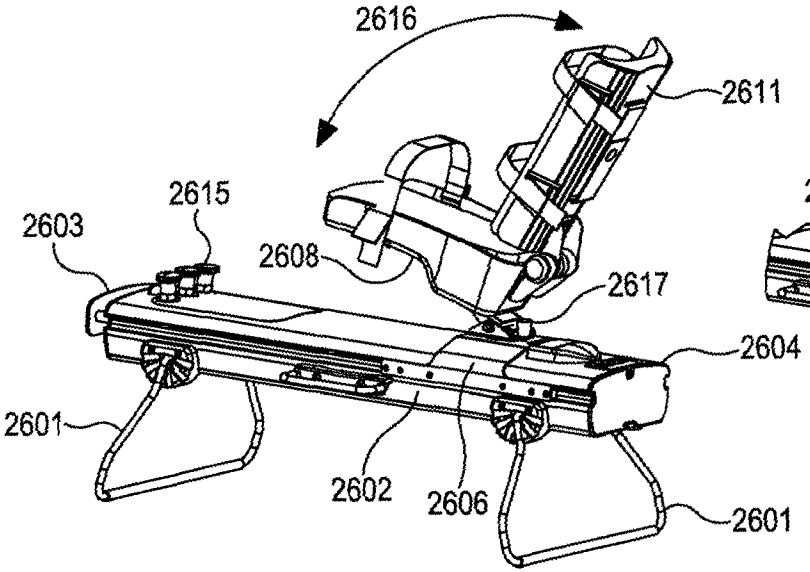
FIG. 28*a* is a perspective view of a device in accordance with the fourth embodiment of the invention, for use by a seated individual to exercise their quadriceps.

Referring to FIGS. 28 *a* to *c*, the difference between the third and fourth embodiments of the present invention is that in the fourth embodiment of the invention, the footplate

2608 and calf plate 2611 which collectively form the leg rest assembly 2616 is rotatable through 180° relative to the longitudinal body of the device 2602. Rotation is about the axis of pivot point 2617 and permits the device versatility to be used for hamstring or quadriceps exercising as determined by the orientation of the leg rest 2616. The gantry/trolley 2606 remains slidably attached to the body 2602 of the apparatus. It will be understood that rotation through substantially 180° relative to the longitudinal body of the device 2602 would also enable a user to switch between hamstring and quadriceps mode.

In a first orientation, for exercising the quadriceps the open side of the gantry or trolley 2606 and footplate 2608 assembly is facing towards the first end of the apparatus 2603 bearing the resistance switches 2615. Movement of the trolley 2606 from the second 2604 to the first end 2603 of the body 2602 is a result of the application of force by the quadriceps pushing through the knee joint to propel the trolley 2606. The force applied by the user is a pushing force against the resistance applied by the resistance members 2614. The user's leg is extended to drive movement of the trolley away from the user.

In a second orientation, the rear of the trolley 2606 and footplate 2608 assembly R faces towards the first end of the device 2603 bearing the resistance switches 2615. Movement of the trolley 2606 from the second 2604 to the first end 2603 of the body 2602 is a result of the application of force by the user's hamstrings pulling the trolley 2606 against the resistance means to propel the trolley 2606. Thus, the device can be interchangeably used to exercise both the quadriceps in a pushing action and the hamstrings via a pulling action. The user's leg is bent to cause movement of the trolley towards the user. The force required by the hamstrings or the quadriceps is variable and is determined by the number of resistance means engaged by the steel cable connected to the gantry 2606.

Once the orientation of the device has been selected according to the exercise required by the user, the footplate 2608 position is secured to the gantry 2606 by a lift plunger 2617. When aligned according to the usage required by the user, the plunger 2617 will automatically locate in the corresponding hole located on the gantry 2606. An adjustable strap may be provided with the fourth embodiment of the invention for securing the device at its second end 2604 to a chair when the device is being use for pushing exercises to propel the gantry/trolley 2606 away from the user by action of their quadriceps. Alternatively, the adjustable strap may be used to secure the device at the first end 2603 to a bed end. The strap may also be positioned around the end of a bed when the device is in use in folded leg configuration on top of said bed and is being used to work the hamstrings by the pulling movement of the patient whose flexing of the leg would pull the trolley 2606 towards the user against resistance to work the hamstrings.

Figure 29A:
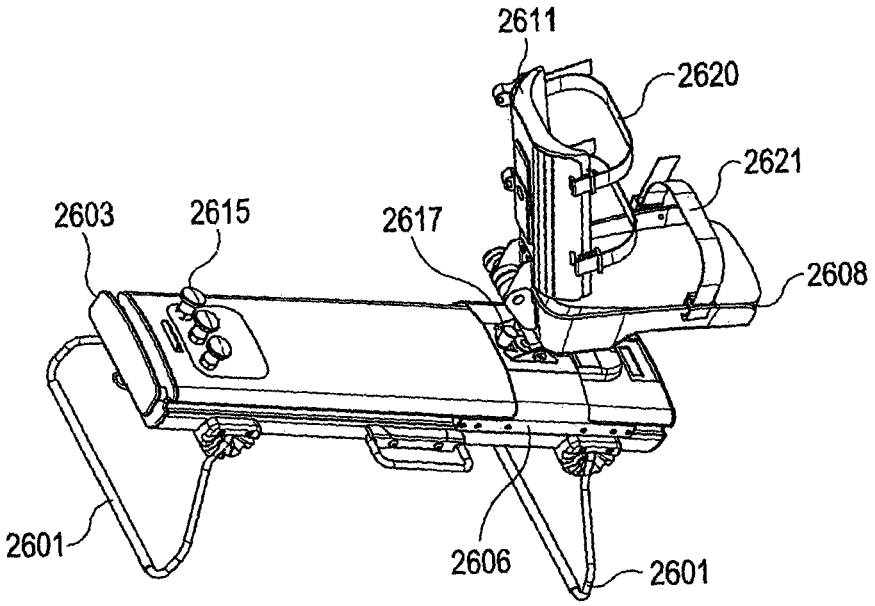
FIGS. 29*a* and 29*b* are a perspective and partial cutaway perspective view of a device in accordance with the fourth embodiment of the invention. The device is shown in configuration for use by a seated individual to exercise their hamstrings.
Figure 29B:
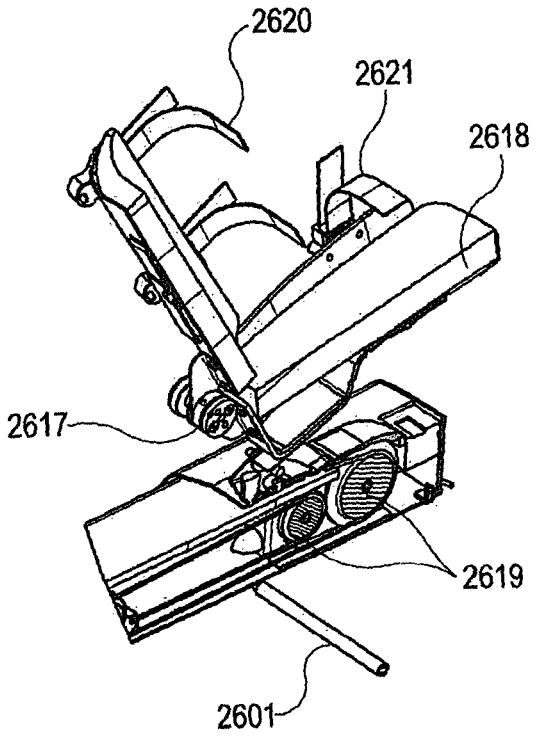

Referring to FIGS. 29*a* and 29*b* are a perspective and partial cutaway perspective view of a device in accordance with the fourth embodiment of the invention. The device is shown with in configuration for use by a seated individual to exercise their hamstrings. The legs of the device 2601 at aligned substantially perpendicular to the body of the device 2602 and support the body of the device above floor level at a height which is suitable for use by a seated individual. A user's foot is positioned on the footplate 2608 and the user's leg is aligned with the ergonomically shaped calf support 2611. The leg is strapped to the footplate and calf support via straps 2621 and 2620 respectively. As with all fourth embodiment figures, like numerals denote like parts.

Figure 30:
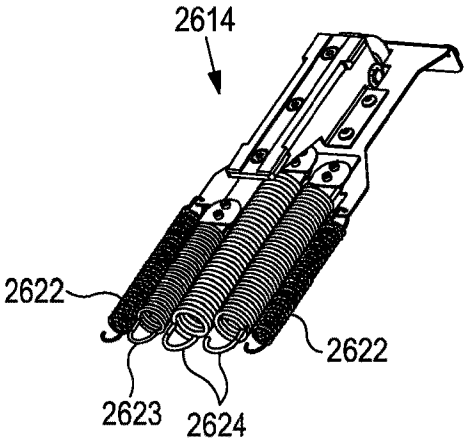
FIG. 30 shows a close up illustration of the resistance component in accordance with the fourth embodiment of the present invention.

FIG. 30 shows a close up illustration of the resistance component in accordance with the fourth embodiment of the present invention. The resistance means 2614 comprise two outer springs 2622, referred to as 'weak springs' that are designed to always return the spring assembly to the start positon and which provide very light resistance; one medium spring 2623; and two strong springs 2624. The springs are mechanically attached via their hook ends to the steel cable via stops, for example organ stop-like plungers (FIG. 29*a*: 2615). The plungers should only be selected when the gantry (FIG. 29*a*: 2606) has returned to the start position (FIG. 26*a*: 2604). When all the plungers are lifted up and rotated by 90° they latch in an upward position to allow the three resistance springs to move freely. When no plungers are down the outer return spring provides a light force of 3 kg. Some of this force will be reduced due to friction. By rotating the first plunger (to the right hand side of an individual using the device) it is released downwardly and acts as an anchor when the spring assembly moves towards the user. It will hold the weak spring back so the user will feel more resistance.

With the weak spring connected (user's right hand plunger down) there is a force of 6.6 kg; with the medium spring connected (user's left hand plunger engaged) there is a force of 10 kg and with the strong spring connected (middle plunger engaged) there is a force of 13 kg. When all spring are connected (all plungers are down) there is a force of 23.6 kg.

Figure 31:
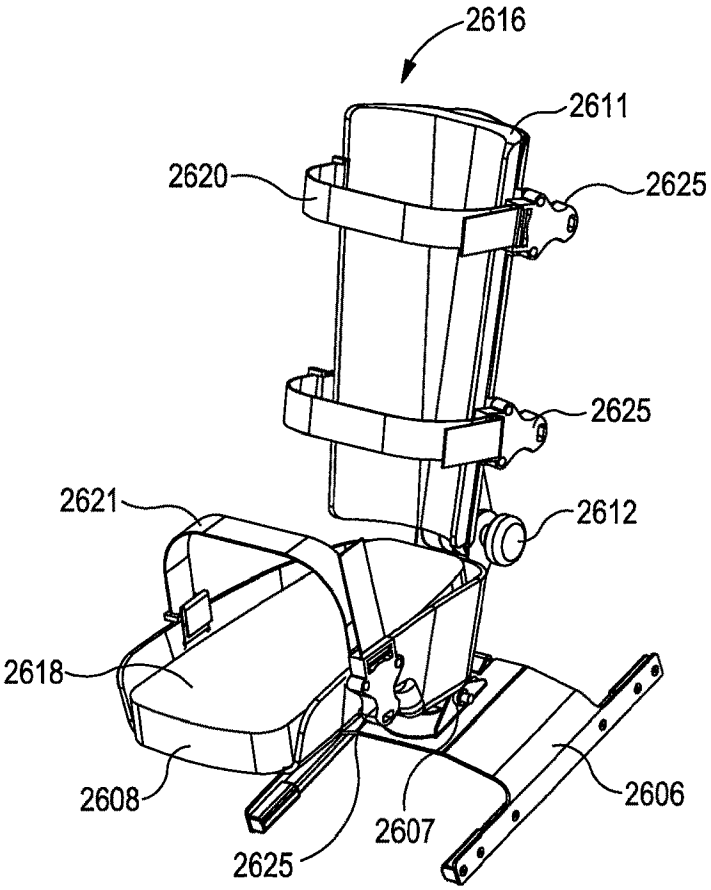
FIG. 31 shows an illustration of the leg rest component in accordance with the fourth embodiment of the present invention.

FIG. 31 shows an illustration of the leg rest 2616 component in accordance with the fourth embodiment of the present invention. The leg rest 2616 comprises a foot plate 2608 hingedly attached to a calf support 2611 via hinge 2612 whose angle is adjustable, so that the angle of the ankle in said foot and calf support to account for the varying degree of flexibility each user has in their ankle joint. The angle between the footplate 2608 and the calf support 2611 is adjustable between 75° and 180°. Counterclockwise movement of the adjustment means which is a knob 2612 reduces the angle between the footplate 2608 and the calf support 2611, whilst clockwise rotation of knob 2612 increases the angle between the footplate and the calf support 2611. The entire leg rest assembly 2616 is pivotally attached at 2607 to the sliding gantry 2606. The orientation of the leg rest 2616 relative to the gantry 2606 is rotatable through 180° relative to the longitudinal body of the device 2602. Rotation is about the axis of pivot point 2607. The gantry/trolley 2606 remains slidably attached to the body 2602 of the apparatus. A user's leg and foot are strapped into the leg rest via straps 2620 and 2621 respectively. Straps 2620 and 2621 are mounted directly to the footplate 2608 and calf support 2611 via plastic buckles 2625 which receive the support straps there through and allow the straps to be tightened around a user's leg and foot.

Figure 32:
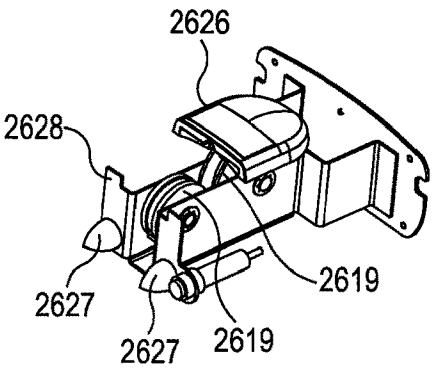
FIG. 32 shows an illustration of a housing component of the device in accordance with the fourth embodiment of the invention.

FIG. 32 shows an illustration of a component of the device in accordance with the fourth embodiment of the invention. A digital counter 2626 is shown mounted on the component which when is situ fits flush with the body of the housing. Two of the pulleys 2619 located within the housing of the apparatus are shown. The pulleys are surrounded by an internal housing 2628 which is attached via screws to the inside of the housing 2602. A pair of abutments 2627 protrude from the internal housing 2628 to provide a stop for the third pulley (FIG. 29*a*: 2620) which moves within the body of the housing.

Figure 33B:
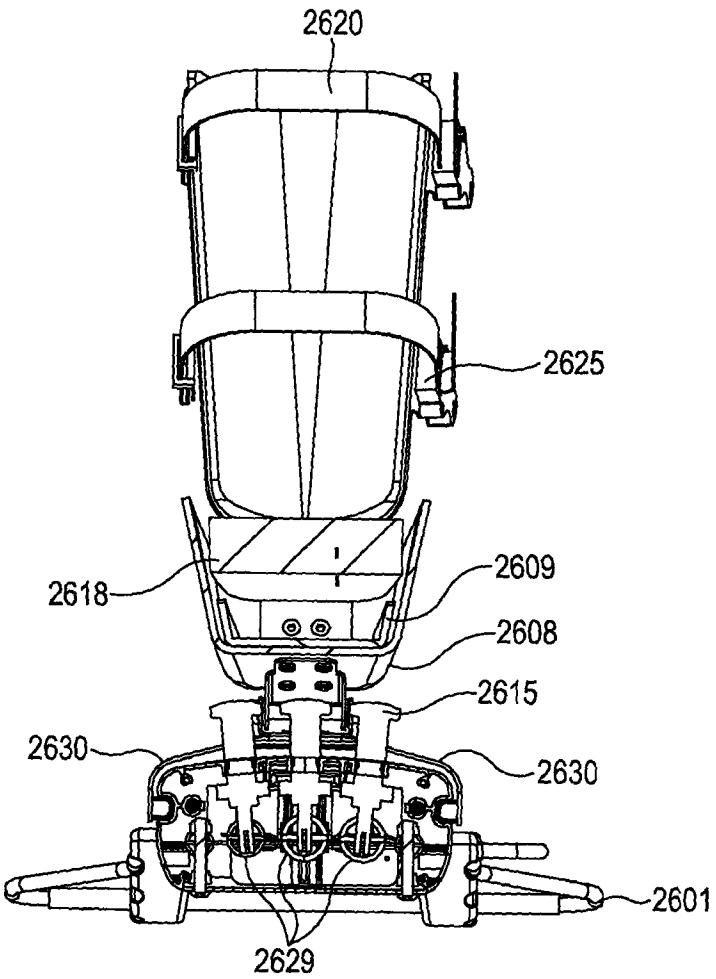
FIGS. 33*a* and 33*b* are a partial cutaway front view of a device in accordance with the fourth embodiment of the invention.
Figure 33A:
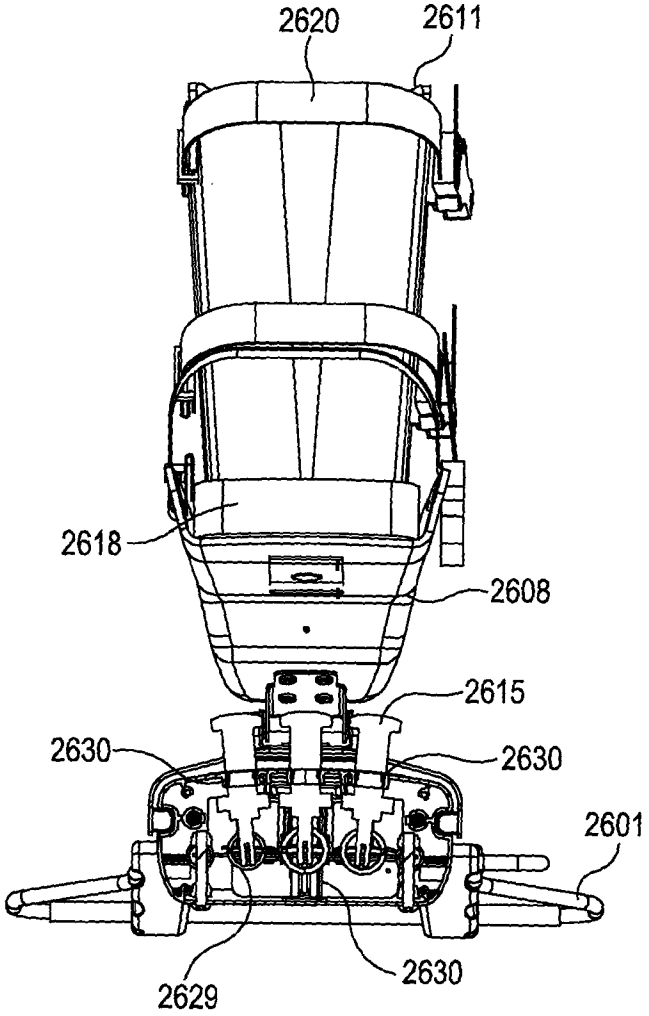

FIGS. 33*a* and 33*b* are partial cutaway front views of a device in accordance with the fourth embodiment of the invention. FIG. 33*a* shows the device in quadriceps configuration with the gantry 2606 located at the first end (FIG. 26*a*: 2603) of the device. FIG. 33*b* shows a partial cutaway view of the device. FIG. 33*a* shows the device in quadriceps configuration with the gantry 2606 located at the second end (FIG. 26*a*: 2604) of the device Each stop means 2615 is coupled to the loop end 2629 of steel springs (FIG. 30: 2622; 2623; 2624) so that when the corresponding knob, stop or plunger 2615 is depressed and pushed downwardly a lower end of the knob, stop or plunger engaged with the central aperture of the loop end of the spring(s) so that the springs are engaged thus increasing the tension experienced by the sliding element, increasing the resistance required by a user to move the footplate of the device. When the knob, stop or plunger 2615 is lifted upwardly, the plunger 2615 pivots about pivot 2630 such that the plunger can rotate 90° and latch in said upward position to allow the three resistance springs (FIG. 30: 2623; 2624) to move freely.

Figure 34A:
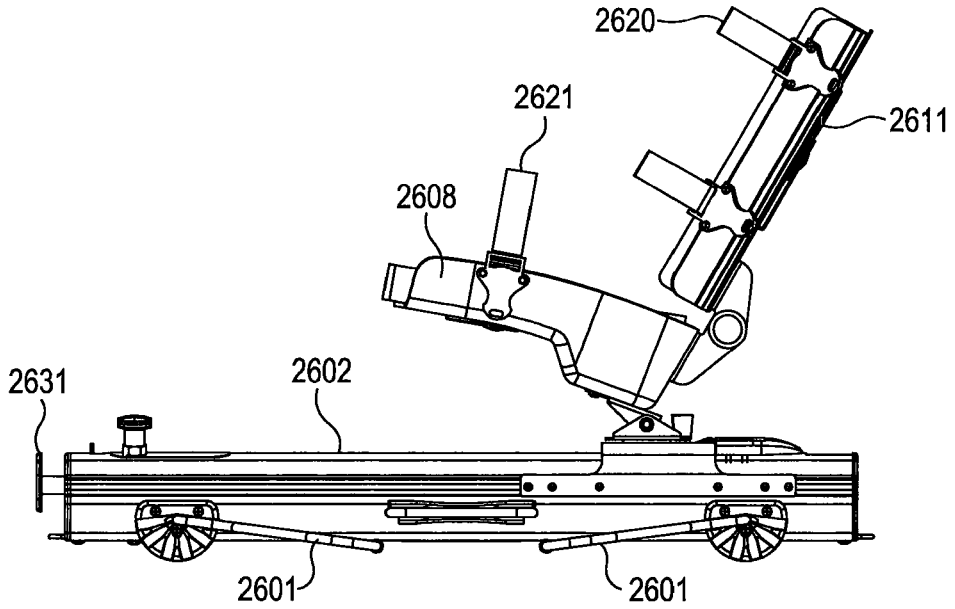
FIGS. 34*a* and 34*b* are side views of a device in accordance with the fourth embodiment of the invention for use on a bed with legs beneath the device.
Figure 34B:
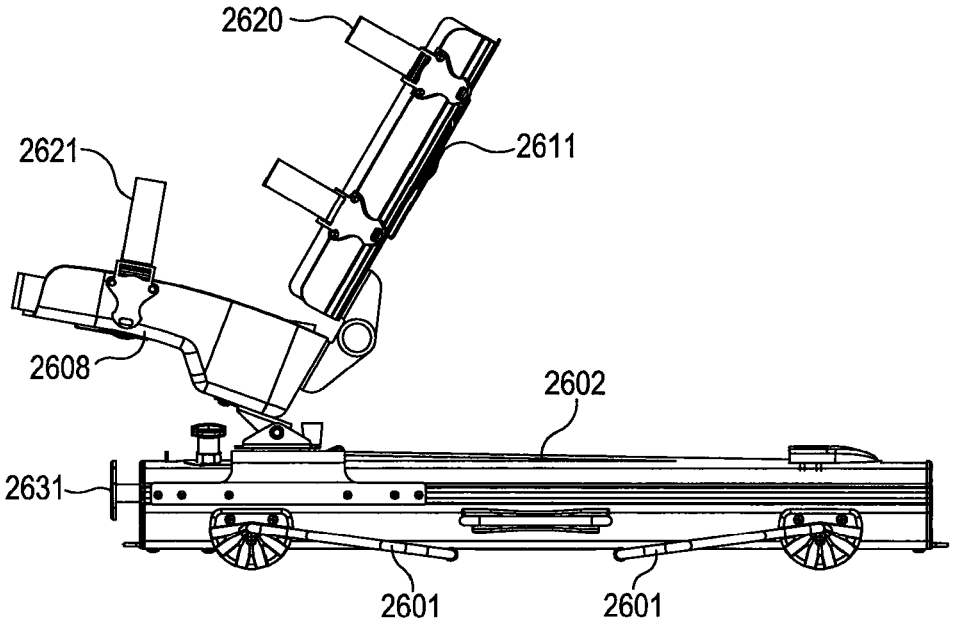

FIGS. 34*a* and 34*b* are side views of a device in quadriceps configuration in accordance with the fourth embodiment of the invention for use on a bed with legs beneath the device. FIG. 34*a* shows the device in quadriceps configuration with the gantry 2606 located at the second end (FIG. 26*a*: 2604) of the device and FIG. 34*b* shows the device with the gantry 2606 located at the first end (FIG. 26*a*: 2603) of the device body 2602. The legs 2601 are folded beneath the device for use on a flat surface for example a bed. The bed end stop 2631 is shown in a retracted position, when extended and the leg rest comprising the footplate 2608 and the calf support 2611 is moved on the gantry 2606 along the body of the device 2602 the position of the device relative to the bed on which the device is being supported is not altered. The bed end stop provides a support brace. Like numerals denote like parts.

Figure 35A:
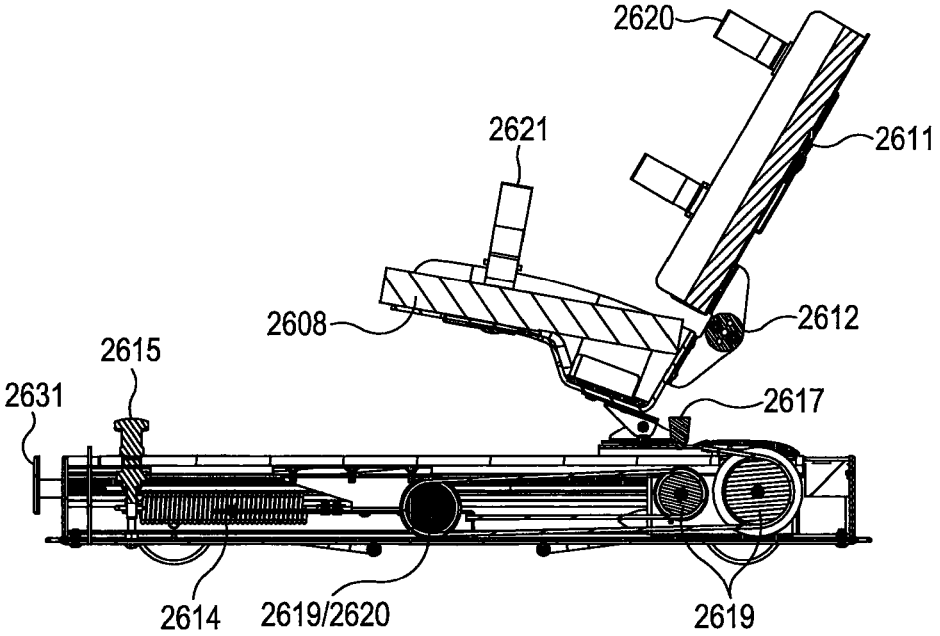
FIGS. 35*a* and 35*b* are cutaway side views of a device in accordance with the fourth embodiment of the invention for use on a bed with legs beneath the device.
Figure 35B:
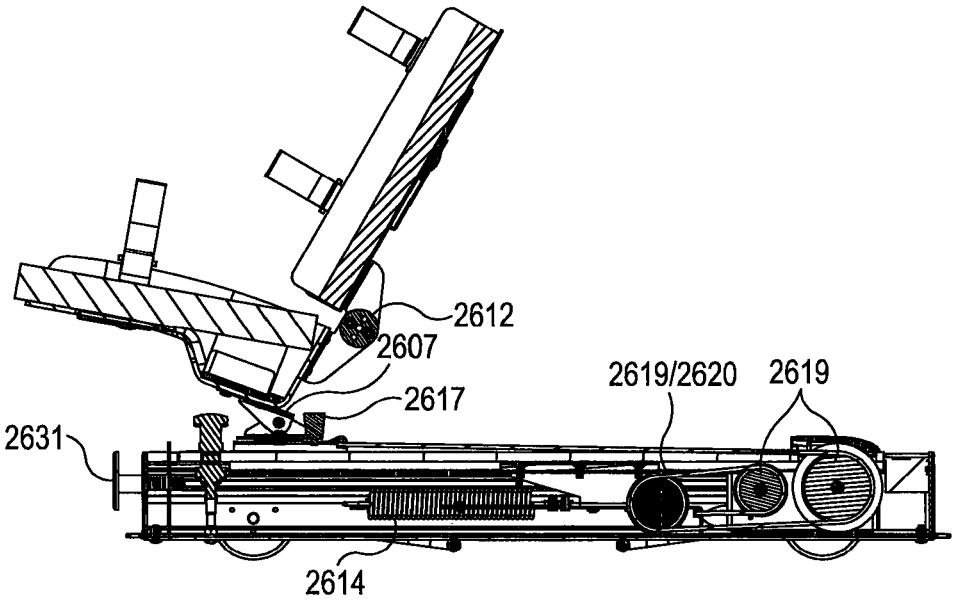

FIGS. 35*a* and 35*b* are cutaway side views of a device in quadriceps configuration accordance with the fourth embodiment of the invention for use on a bed with legs beneath the device. FIG. 35*a* shows the device in quadriceps configuration with the gantry 2606 located at the second end (FIG. 26*a*: 2604) of the device and FIG. 35*b* shows the device with the gantry 2606 located at the first end (FIG. 26*a*: 2603) of the device body 2602. When the leg rest is at the first end of the device the third pulley 2620 which moves with the movement of the gantry 2606 is located remote from the other two pulleys 2619. When the leg rest is at the second end of the device the third pulley 2620 which moves with the movement of the gantry 2606 is located in close proximity to the other two pulleys 2619. The legs 2601 are folded beneath the device for use on a flat surface for example a bed. The bed end stop 2631 is shown retracted.

Figure 36:
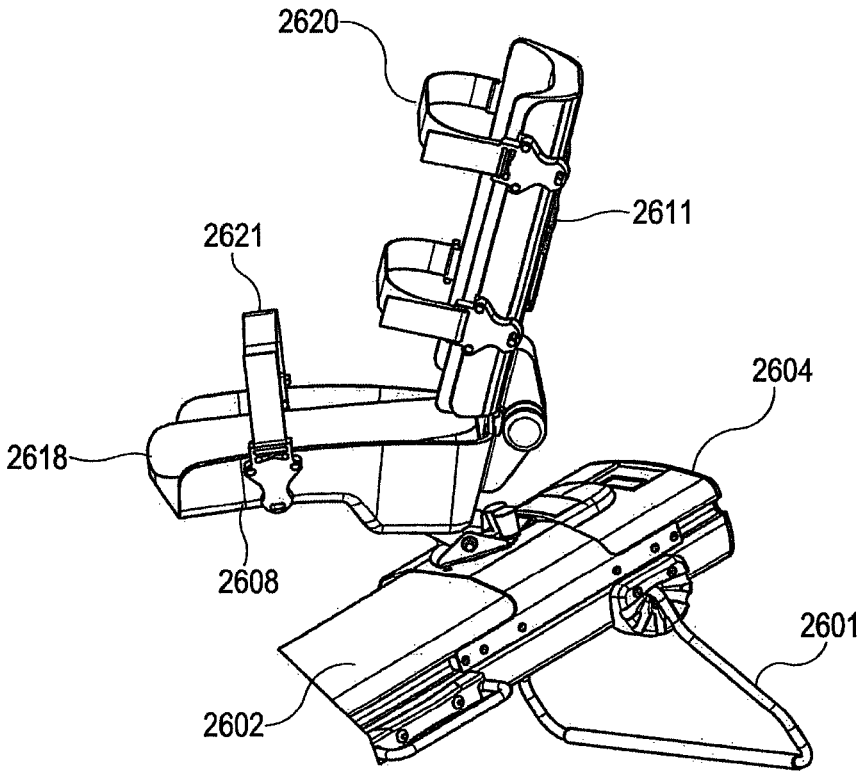
FIG. 36 is a partial perspective view of the device in accordance with the fourth embodiment of the invention for by a seated individual. The leg rest is shown in an intermediate position between the respective positions for a user exercising their quadriceps or hamstrings.

FIG. 36 is a partial perspective view of the device in accordance with the fourth embodiment of the invention for by a seated individual. The leg rest is shown in an intermediate position between the orientation required by a user to exercise their quadriceps or hamstrings. Like numerals denote like parts.

Figure 37A:
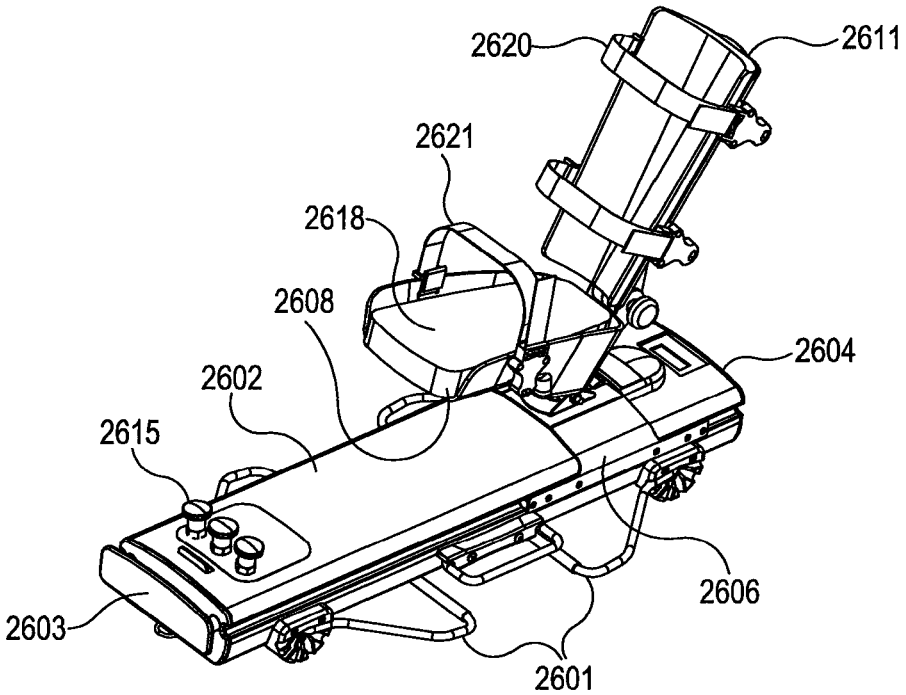
FIGS. 37*a* and 37*b* are perspective views of a device in accordance with the fourth embodiment of the invention for use on a bed with legs beneath the device.
Figure 37B:
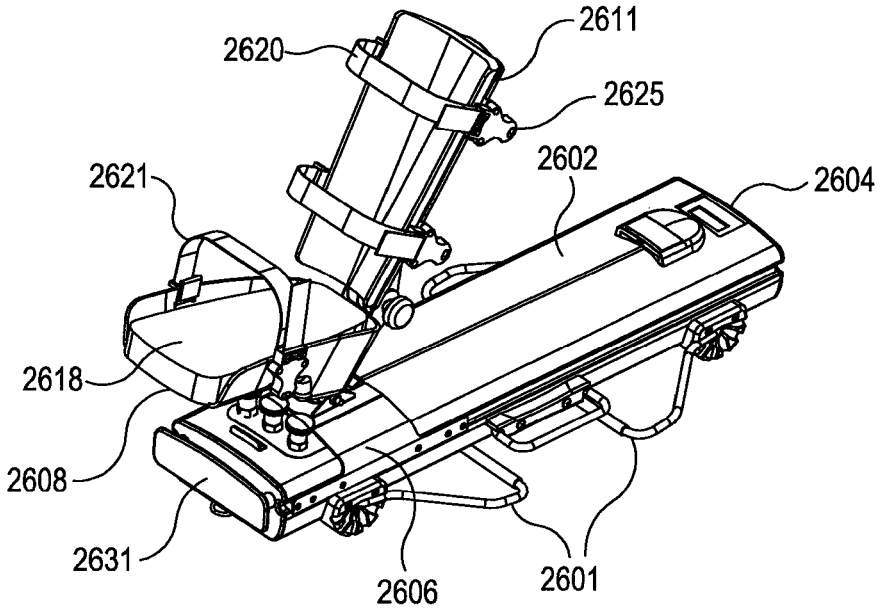

FIGS. 37*a* and 37*b* are perspective views of a device in accordance with the fourth embodiment of the invention for use on a bed with legs beneath the device. FIG. 37*a* shows the device in quadriceps configuration with the gantry 2606 located at a second end 2604 of the body 2602. FIG. 37*b* shows the device in with the trolley/gantry 2606 located at a first end 2603 of the body 2602. Like numerals denote like parts.

Figure 38A:
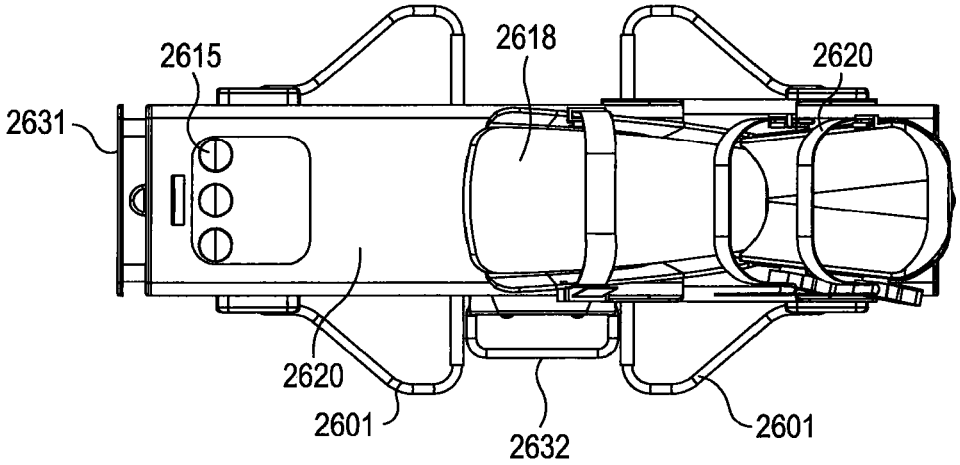
FIGS. 38*a* and 38*b* are plan views of a device in accordance with the fourth embodiment of the invention for use on a bed with legs beneath the device.
Figure 38B:
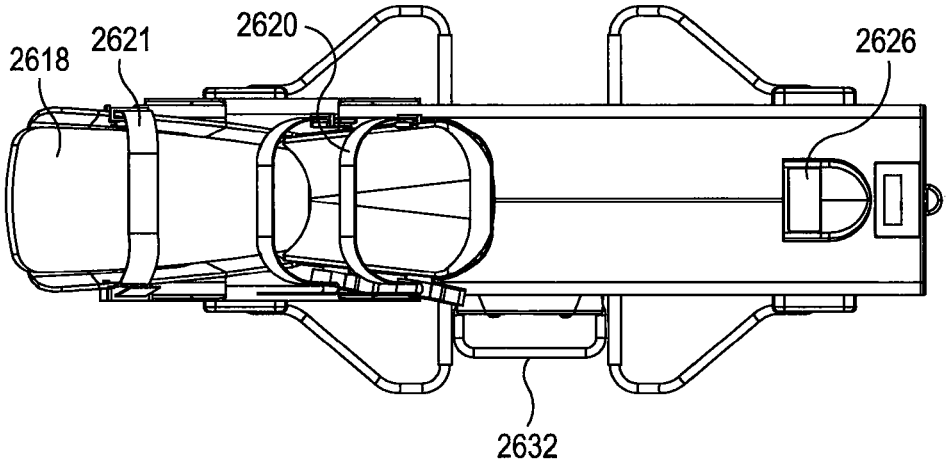

FIGS. 38*a* and 38*b* are plan views of a device in accordance with the fourth embodiment of the invention for use on a bed with legs beneath the device, a handle 2632 is provided for transport of the device. FIG. 38*a* shows the device in quadriceps configuration with the gantry 2606 located at a second end 2604 of the body 2602. FIG. 38*b* shows the device in quadriceps configuration with the trolley/gantry 2606 located at a first end 2603 of the body 2602. Like numerals denote like parts.

Figure 39A:
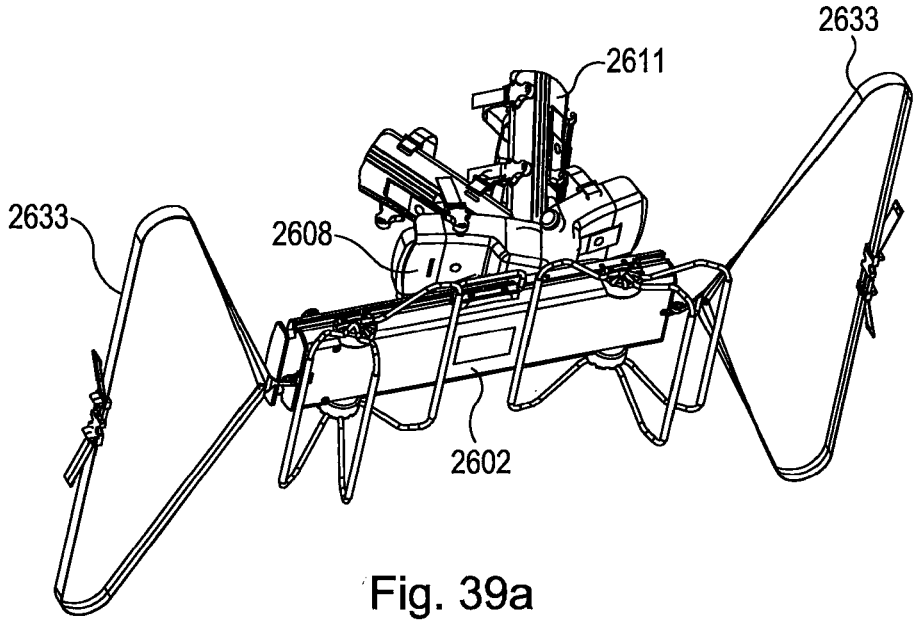
FIGS. 39*a* and 39*b* are rear perspective views of a device in accordance with the fourth embodiment of the invention. Securing straps are shown at both ends of the device the three possible positions of the moveable legs are all illustrated.
Figure 39B:
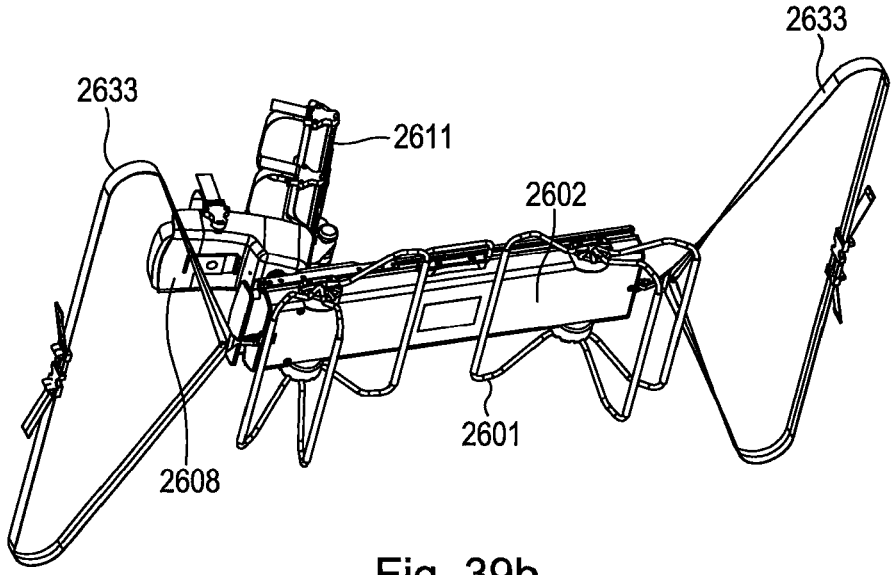

FIGS. 39*a* and 39*b* are rear perspective views of a device in accordance with the fourth embodiment of the invention. Securing straps 2633 are shown at both ends of the device the three possible positions of the moveable legs are all illustrated. FIGS. 39*a* and 39*b* show the device in quadriceps configuration.

Figure 40:
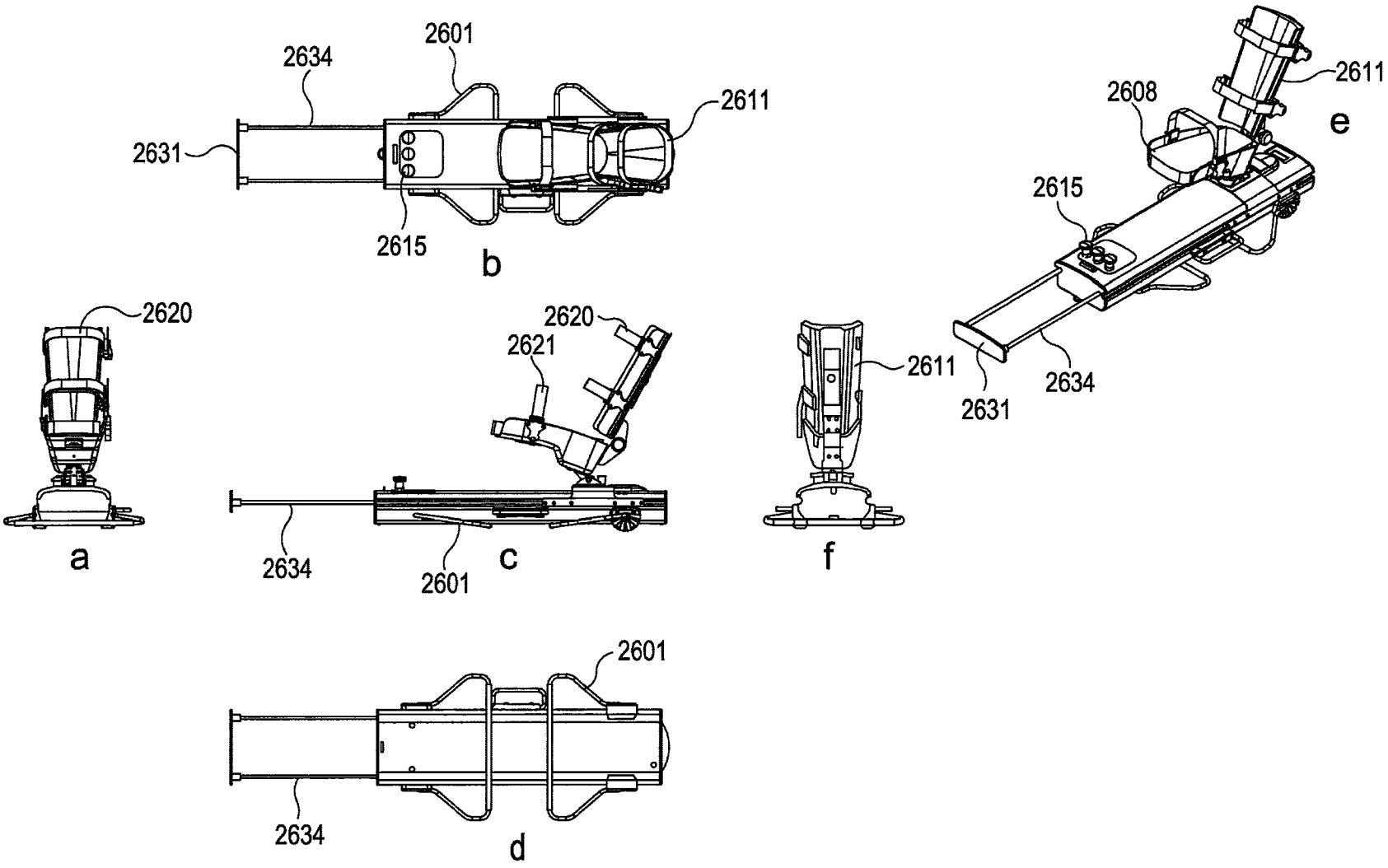
FIGS. 40 *a* and 40*f* are end views.

FIGS. 40*a*, 40*b*, 40*c*. 40*d*, 40*e* and 40*f* show various views of a device in accordance with the fourth embodiment of the invention for use on a bed with legs beneath the device and the bed end stop 2631 extended. The bed end stop is mounted on two rod like projections 2634 which are stowed in the body of the device when the bed end stop is not in use. The device is configured for exercising the quadriceps. FIGS. 40*a* and 40*f* are end views, FIG. 40*b* is a plan view, FIG. 40*c* is a side view, FIG. 40*d* a rear view and FIG. 40*e* a perspective view.

Figure 41:
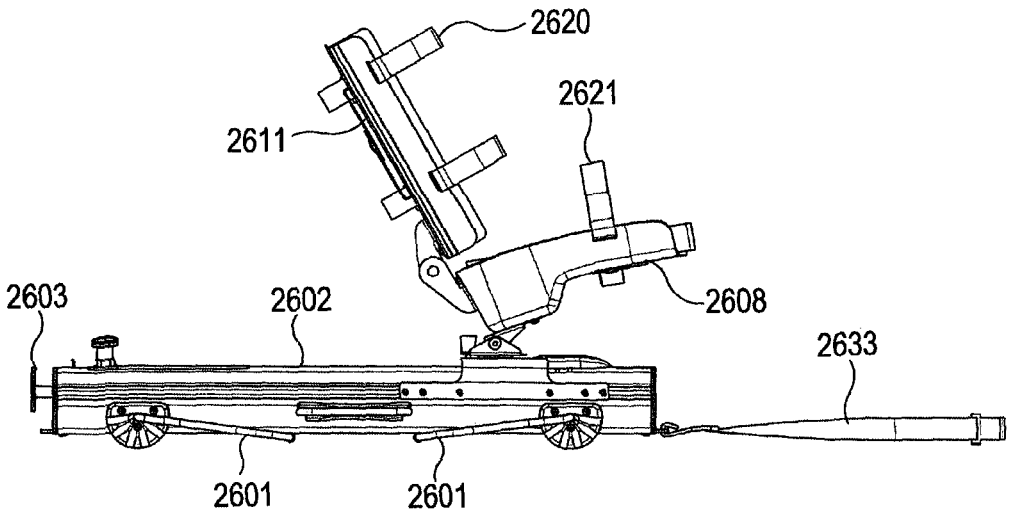
FIG. 41 is a side view of a device in accordance with the fourth embodiment in hamstring configuration for use on a bed with legs beneath the device.

FIG. 41 shows a side view of a device in hamstring configuration accordance with the fourth embodiment of the invention for use on a bed with legs beneath the device. The gantry 2606 located at the second end (FIG. 26*a*: 2604) of the device. The legs 2601 are folded beneath the device for use on a flat surface for example a bed. The bed end stop 2631 is shown in a retracted configuration, when the bed end stop is extended the position of the device relative to the bed on which the device is supported is not altered when the trolley 2606 is moved along the body of the device 2602. The bed end stop provides a support brace. The optional securing strap 2633 which may also be used as a carrying strap is shown at the second end of the device. Like numerals denote like parts.

Figure 42:
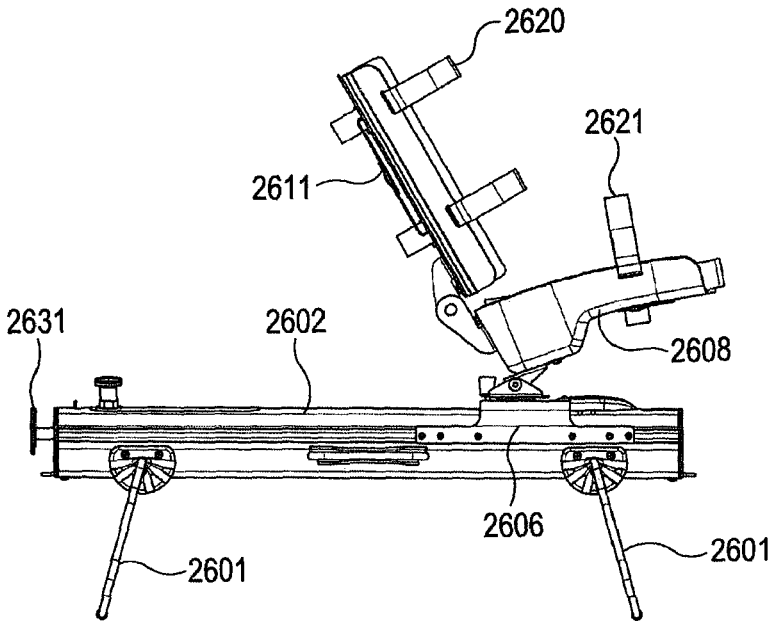
FIG. 42 is a side view of a device in accordance with the fourth embodiment in hamstring configuration for use by a seated individual with legs extending from the device.

FIG. 42 shows a side view of a device in hamstring configuration accordance with the fourth embodiment of the invention for use by an individual seated in a chair. The gantry 2606 located at the second end (FIG. 26*a*: 2604) of the device body 2602. The legs 2601 are outstretched beneath the device at approximately 80-85° relative to the body of the device 2602 to elevate the device from floor level. The bed end stop 2631 is shown in a retracted, stowed configuration. Like numerals denote like parts.

In the embodiments disclosed herein, the footrest has adjustability to have either no pressure on the heel area, or full pressure on the heel area, depending upon the individual patient's needs. The devices may allow no pressure during the action of the movement of the device for those patients who have pressure sores or fragile skin on their heels or full pressure for those for example with neurological conditions to avoid an increase in tone and the leg muscles.

In prior art devices, these have the disadvantages that there is no way to stop those devices from moving about as they are being used. However various ones of the present embodiments have the following advantageous features:

If a patient requires the device to work their hamstrings, the foot rest/leg rest will rotate on its axis substantially 180° to face in the opposite direction. The person/patient will sit at the other end of the device, and/or the device will be turned around 180° for them to use, and they will rest the leg in the leg rest as usual, but will be able to pull the trolley towards them using a knee flexion/bend, instead of pushing it away using an extension, and therefore using the hamstring muscles, rather than the quads. This is made possible because of the block and tackle feature set up inside the device.

This mechanism is a 3 pulley system attached to the 5 internal resistance springs 2614. This allows the trolley 2602 and footplate assembly to travel three times further than the extension of the springs, but the spring force needs to be three times stronger.

An adjustable, telescopic end stop at the front end of the device maintains correct position of the device on the bed and stops the device from being pushed down a hospital bed by a patient doing pushing/extending actions to work the quadriceps muscles.

The adjustable strap, being the same one that is used to maintain the device in the correct position when used in chair mode, that can be positioned around the end of the hospital bed to avoid the device from being moved up the bed by the action of the patient flexing their leg in the device, to work the hamstrings, when the leg rest has been rotated around and the device is being used the other way round.

The device has all mechanical moving parts inside the body of the device, which ensures a smooth outer surface and therefore avoids collection of skin debris and minimizes the risk of cross infection between patients using the device.

Rotation about the footrest may be up to 180° allowing the device to rotate between hamstring and quadriceps configuration.

There is also provided a counter adjustability between the footplate and the calf support to adjust the angle in which the user's foot is held.

It will be understood that various modifications will be apparent to those skilled in the art. For example the nylon slide plate or trolley may be replaced by any other form of moveable mechanism anchorable to the base of the footplate. The steel cable may be replaced with an alternative reinforced connecting means e.g. a chain or reinforced fibers.

The invention claimed is:

1. A portable therapeutic leg strengthening apparatus comprising:

a longitudinal body having first and second ends;

a guide member moveable between said first and second ends in a direction parallel to a main length of said longitudinal body;

a footplate pivotally connected to said guide member;

a calf support adjustably connected to said footplate;

one or a plurality of resiliently biased members connected to said guide member for generating a resistance to movement of the guide member relative to the longitudinal body; and a connector for connecting said one or plurality of resiliently biased members to said longitudinal body, wherein the connector is a cable;

said one or plurality of resiliently biased members providing variable resistance to said connector to increase or decrease a force required by a user to move said guide member between said first and second ends of said longitudinal body;

wherein an angle of connection between the footplate and the calf support is adjustable; and wherein said footplate and said calf support form a leg rest, configurable between first and second configurations, such that:

in said first configuration the leg rest is arranged such that the guide member is pushed against the resistance generated by said one or plurality of resiliently biased members between said first and second ends of the longitudinal body to exercise quadriceps of the user and in said second configuration the guide member is pulled against the resistance generated by said one or plurality of resiliently biased members between said first and second ends of the longitudinal body to exercise a hamstring of the user.

2. The apparatus according to claim 1, further comprising a bed end stop to stabilize the apparatus in use on a bed.

3. The apparatus according to claim 2, wherein the bed end stop comprises two elongate support rods.

4. The apparatus according to claim 3, wherein the bed end stop further comprises a bridging piece between said two elongate support rods.

5. The apparatus according to claim 1 wherein the extension of the one or plurality of resiliently biased members is regulated by a block and tackle mechanism.

6. The apparatus according to claim 5 wherein the block and tackle mechanism comprises three pulleys.

7. The apparatus according to claim 1, wherein said one or plurality of resiliently biased members are one or a plurality of springs.

8. The apparatus according to claim 7, further comprising a stop to engage said one or plurality of springs and said connector.

9. The apparatus according to claim 1, wherein the footplate and calf support each further comprise a removable liner.

10. The apparatus according to claim 9, wherein said removable liners are magnetically aligned with the footplate and the calf support.

11. The apparatus according to claim 1, wherein said guide member is rotatable by 180° relative to the longitudinal body about a pivot point.

12. The apparatus according to claim 1, wherein the apparatus further comprises a removable heel support locatable within said footplate, configurable between first and second positions such that:

in a first position the heel support is arranged such that the user exerts pressure through a ball of a foot of the user to move the guide member between the first and second ends of the longitudinal body and in a second position the heel support is arranged so that the user exerts pressure through a heel of the foot of the user to move the guide member between the first and second ends of the longitudinal body.

13. The apparatus according to claim 1, wherein said one or plurality of resiliently biased members are elastic or rubber cords.

14. A portable therapeutic leg strengthening apparatus comprising:

a longitudinal body having first and second ends;

a guide member moveable between said first and second ends in a direction parallel to a main length of said longitudinal body;

a footplate pivotally connected to said guide member;

a calf support adjustably connected to said footplate;

one or a plurality of resiliently biased members connected to said guide member for generating a resistance to movement of the guide member relative to the longitudinal body; and a connector for connecting said one or plurality of resiliently biased members to said longitudinal body, wherein the connector comprises a cable;

said one or plurality of resiliently biased members providing variable resistance to said connector to increase or decrease a force required by a user to move said guide member between said first and second ends of said longitudinal body;

wherein an angle of connection between the footplate and the calf support is adjustable; and wherein said footplate and said calf support form a leg rest, rotatable between first and second configurations, such that:

in said first configuration the leg rest is arranged such that the guide member is pushed against the resistance generated by said one or plurality of resiliently biased members between said first and second ends of the longitudinal body to exercise quadriceps of the user and in said second configuration the guide member is pulled against the resistance generated by said one or plurality of resiliently biased members between said first and second ends of the longitudinal body to exercise a hamstring of the user.

* * * * *